US011589721B2

(12) United States Patent
Park et al.

(10) Patent No.: US 11,589,721 B2
(45) Date of Patent: Feb. 28, 2023

(54) CLEANING UNIT HAVING AGITATOR

(71) Applicant: LG ELECTRONICS INC., Seoul (KR)

(72) Inventors: Jongho Park, Seoul (KR); Sangik Lee, Seoul (KR); Woo Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/638,602

(22) PCT Filed: Jul. 24, 2020

(86) PCT No.: PCT/KR2020/009747
§ 371 (c)(1),
(2) Date: Feb. 25, 2022

(87) PCT Pub. No.: WO2021/040240
PCT Pub. Date: Mar. 4, 2021

(65) Prior Publication Data

US 2022/0265102 A1 Aug. 25, 2022

(30) Foreign Application Priority Data

Aug. 30, 2019 (KR) ..... 10-2019-0107576

(51) Int. Cl.
*A47L 9/04* (2006.01)
*A47L 9/28* (2006.01)
(Continued)

(52) U.S. Cl.
CPC ..... *A47L 9/0477* (2013.01); *A46B 9/026* (2013.01); *A46B 13/001* (2013.01); *A46B 13/02* (2013.01);
(Continued)

(58) Field of Classification Search
CPC ..... A46B 9/026; A46B 13/001; A46B 13/02; A46L 9/0411; A46L 9/0494;
(Continued)

(56) References Cited

U.S. PATENT DOCUMENTS

2009/0049642 A1 2/2009 Oh et al.
2015/0320278 A1 11/2015 Hyun et al.
(Continued)

FOREIGN PATENT DOCUMENTS

CN 105078366 11/2015
CN 105361810 3/2016
(Continued)

OTHER PUBLICATIONS

KR-100504891 translation Espacenet (Year: 2022).*
(Continued)

*Primary Examiner* — Joseph J Hail
*Assistant Examiner* — Timothy Brady
(74) *Attorney, Agent, or Firm* — Ked & Associates, LLP

(57) ABSTRACT

The present invention provides a cleaning unit, comprising: a columnar body part having a rotation guide opening formed on the outer circumferential surface thereof; a shaft installed to reciprocate a predetermined distance in the longitudinal direction thereof in a hollow formed in the body part; a drive part that protrudes from the shaft in the radial direction thereof; a brush part that has one side installed on the outer circumferential surface of the body part along the longitudinal direction thereof and rotates on the basis of the one side as a rotation axis; and a driven part that extends from the brush part toward the drive part, passes through the rotation guide opening, and is inserted into a rotation guide groove formed in the drive part. The rotation guide groove extends at a predetermined angle with respect to the longitudinal direction of the shaft, and as the shaft reciprocates,
(Continued)

the driven part is guided to rotate by means of the rotation guide groove, and the brush is rotated by means of the rotation of the driven part. The cleaning unit may include a robot cleaner or a cleaner operated by means of a user's operation.

17 Claims, 20 Drawing Sheets

(51) Int. Cl.
*A46B 9/02* (2006.01)
*A46B 13/00* (2006.01)
*A46B 13/02* (2006.01)

(52) U.S. Cl.
CPC ..... *A47L 9/0411* (2013.01); *A47L 9/0455* (2013.01); *A47L 9/0483* (2013.01); *A47L 9/2831* (2013.01); *A47L 9/2847* (2013.01); *A46B 2200/3033* (2013.01); *A47L 2201/06* (2013.01)

(58) Field of Classification Search
CPC .... A46L 9/0633; A46L 9/0477; A46L 9/0455; A46L 9/0483; A46L 9/2831; A46L 9/2847
USPC ..... 15/319
See application file for complete search history.

(56) References Cited

U.S. PATENT DOCUMENTS

| | | | | |
|---|---|---|---|---|
| 2018/0168417 | A1* | 6/2018 | Goddard | A47L 11/4013 |
| 2018/0184865 | A1* | 7/2018 | Lee | A47L 7/0066 |
| 2018/0338654 | A1* | 11/2018 | Kelsey | A47L 9/0477 |
| 2019/0208971 | A1* | 7/2019 | O'Brien | A47L 11/4041 |

FOREIGN PATENT DOCUMENTS

| | | | |
|---|---|---|---|
| CN | 106539534 | | 3/2017 |
| CN | 107252276 | | 10/2017 |
| CN | 207666529 | | 7/2018 |
| CN | 207666530 | | 7/2018 |
| CN | 209032121 | | 6/2019 |
| JP | 59-225029 | | 12/1984 |
| JP | 04-049928 | | 1/1992 |
| JP | H05-56889 | | 3/1993 |
| JP | 2010-284526 | | 12/2010 |
| JP | 2018-061682 | | 4/2018 |
| KR | 10-2004-0092223 | | 11/2004 |
| KR | 10-0504891 | | 7/2005 |
| KR | 100504891 | * | 7/2005 |
| KR | 10-2013-0143261 | | 12/2013 |
| KR | 10-2014-0140854 | | 12/2014 |
| KR | 10-1476212 | | 12/2014 |
| KR | 10-2016-0027782 | | 3/2016 |
| KR | 10-1610258 | | 4/2016 |
| KR | 10-1984574 | | 5/2019 |
| RU | 2308213 | | 10/2007 |
| RU | 2370199 | | 10/2009 |
| RU | 2463945 | | 10/2012 |

OTHER PUBLICATIONS

International Search Report dated Dec. 1, 2020 issued in Application No. PCT/KR2020/009747.
Korean Notice of Allowance dated Nov. 19, 2020 issued in Application No. 10-2019-0107576 (English translation attached).
Chinese Notice of Allowance dated Jul. 6, 2022 issued in CN Application No. 202080061174.2.
Russian Office Action dated Aug. 23, 2022 issued in RU Application No. 2022107865.

* cited by examiner

CLEANING UNIT HAVING AGITATOR

CROSS-REFERENCE TO RELATED PATENT APPLICATIONS

This application is a U.S. National Stage Application under 35 U.S.C. § 371 of PCT Application No. PCT/KR2020/009747, filed Jul. 24, 2020, which claims priority to Korean Patent Application No. 10-2019-0107576, filed Aug. 30, 2019, whose entire disclosures are hereby incorporated by reference.

TECHNICAL FIELD

The present disclosure relates to a cleaning unit, and more particularly, to a cleaning unit having an agitator with a rotating brush when a cleaner is operated on a carpet.

BACKGROUND ART

A cleaner is a device that performs a vacuum cleaning function by sucking dust and foreign substances together with air and separating them to collect dust. The cleaner includes a suction nozzle module, and the suction nozzle module comes into contact with a surface to be cleaned to suck dust and foreign substances present on the surface together with air. In particular, the cleaner is mainly operated in a floor environment.

The suction nozzle module has an agitator for floating or picking up dust and foreign substances from the surface to be cleaned. A brush or rubber plate protrudes from an outer peripheral surface of a cylindrical body of the agitator, and as the agitator rotates, the brush or rubber plate rotates together to float or pick up dust and foreign substances from a floor. Floating or picked up dust and foreign substances are sucked through the suction nozzle module to be separated and collected.

However, when the floor environment is a carpet environment, since the suction nozzle module is spaced apart from a surface of the carpet, the brush or rubber plate of the agitator does not reach the surface of the carpet, thereby decreasing cleaning performance.

In order to solve the problem, it is necessary to extend a length of the brush or rubber plate of the agitator.

For example, Chinese Patent Publication No. CN 207666529 U (published on Jul. 31, 2018) discloses an agitator capable of varying a length of a brush in a stepwise manner in which a plurality of grooves having different heights are disposed on a body of the agitator to allow the brush to be separated from and assembled into the plurality of grooves.

However, for this purpose, a user has to separate the brush from the existing groove and assemble it into another groove whenever the floor environment changes, there is a sanitary problem in that the user has to touch dust accumulated in the agitator with his or her hand, a time loss occurs for replacement, and also there is a problem that cannot be applied to an automatic cleaning device such as a robot cleaner.

In consideration of the user's hygiene and convenience, a cleaner having a structure capable of easily modifying a length of the brush or rubber plate of the agitator according to a change of the floor environment should be proposed.

In addition, in consideration of applicability to an automatically operated device such as a robot cleaner, a cleaner having a structure capable of recognizing a change of the floor environment to modify the length of the brush or rubber plate of the agitator without user manipulation should be proposed.

DISCLOSURE OF INVENTION

Technical Problem

An aspect of the present disclosure is to provide a cleaning unit capable of varying a rotation radius of a brush in response to a change of the floor environment. In particular, an aspect of the present disclosure is to provide a cleaning unit having a structure capable of easily varying the rotation radius of the brush without touching dust by hand in a process of varying the rotation radius of the brush. In particular, an aspect of the present disclosure is to provide a cleaning unit having a structure capable of automatically varying the rotation radius of the brush in response to the floor environment.

An aspect of the present disclosure is to provide a cleaning unit having a structure in which a brush can be rotated on an outer peripheral surface of a body portion as a shaft inserted into a hollow of a body member of the agitator along a length direction of the body member moves horizontally.

An aspect of the present disclosure is to provide a cleaning unit having a structure capable of applying an appropriate pressure when the brush strokes a surface to be cleaned.

An aspect of the present disclosure is to provide a cleaning unit having a structure capable of pushing or pulling one side of the shaft to allow the shaft of the agitator to move horizontally when the agitator rotates.

Solution to Problem

In order to achieve the objectives of the present disclosure, the present disclosure provides a cleaning unit, including a columnar body portion in which a rotation guide hole is disposed on an outer peripheral surface thereof; a shaft provided to reciprocate a predetermined distance in a length direction in a hollow disposed in the body portion; a driving portion protruding from the shaft in a radial direction; a brush portion having one side provided on an outer peripheral surface of the body portion along the length direction to rotate with the one side as a rotation axis thereof; and a driven portion extending from the brush portion toward the driving portion to be inserted into a rotation guide groove disposed in the driving portion through the rotation guide hole, wherein the rotation guide groove extends at a predetermined angle with respect to the length direction of the shaft, and wherein as the shaft reciprocates, the driven portion is guided to rotate by the rotation guide groove, and the brush portion is rotated by the rotation of the driven portion.

Furthermore, the brush portion and the driven portion extending from the brush portion may be disposed in plurality in the body portion along a circumferential direction, and the rotation guide groove may be disposed in plurality on the driving portion along the circumferential direction.

Furthermore, the driving portion may be disposed in plurality along the length direction on the shaft, and the driven portion may be disposed in plurality along the length direction of the brush portion.

Moreover, a distance between the shaft and the other end of the brush portion may become the minimum when the shaft is maximally moved toward one side of the body portion, and become the maximum when the shaft is maximally moved toward the other side opposite to the one side.

Moreover, the cleaning unit may further include a fixed brush portion extending radially outward from the outer peripheral surface of the body portion, a distance between the shaft and the other end of the brush portion may be spaced apart by a first rotation radius, which is a minimum value, when the shaft is maximally moved toward one side of the body portion, and may be spaced apart by a second rotation radius, which is a maximum value, when the shaft is maximally moved toward the other side opposite to the one side, and a distance between the shaft and a radially outer side end portion of the fixed brush portion may be larger than the first rotation radius, and may be smaller than the second rotation radius.

Furthermore, the brush portion may include a first brush and a second brush respectively extending from one side of the brush portion to a radially outer side of the body portion, wherein the first brush and the second brush form a predetermined angle to each other, and extension direction lengths of the first brush and the second brush are disposed to be different from each other.

Furthermore, the body portion may include a hollow body member disposed with a recess groove on which the brush portion is provided on an outer peripheral surface thereof, both ends of which are open; and a first end cap and a second end cap respectively fitted to both ends of the body member to cover the both ends, respectively.

Moreover, one side of the brush portion may be accommodated in the recess groove, rotation protrusions may be disposed at both ends of one side of the brush portion in a length direction, and the first end cap and the second end cap may be provided with receiving holes rotatably coupled to the rotation protrusions.

Moreover, the shaft may include a power transmission pin passing through one side of the shaft, and the first end cap may include a shaft guide portion slidably coupled to one side of the shaft.

Furthermore, a shaft guide hole slidably coupled to the shaft may be disposed in the second end cap, and the shaft may include an E-ring protruding in a radial direction, and the E-ring may be disposed in plurality with the second end cap interposed therebetween to limit a reciprocating movement distance of the shaft.

Furthermore, the cleaning unit may further include a shaft receiving portion mounted on the other side of the shaft, wherein a bearing is inserted between the shaft receiving portion and the shaft, and the E-ring is disposed in plurality with the shaft receiving portion therebetween to fix the shaft receiving portion in a length direction.

Furthermore, the cleaning unit may further include a first power module coupled to the first end cap to rotate the shaft; a second power module connected to the shaft receiving portion to push and pull the shaft receiving portion according to operation information; a sensor connected to the first power module and configured to detect a current value of the first power module; and a controller that calculates the operation information, which is electrically connected to the second power module to transmit the calculated operation information to the second power module, and electrically connected to the sensor to receive a current value of the first power module that is detected from the sensor, wherein the controller calculates the operation information using the detected current value of the first power module.

Moreover, the operation information may include first operation information and second operation information, wherein the second power module receives the first operation information to push the shaft receiving portion at a predetermined pressure, and receives the second operation information to pull the shaft receiving portion at a predetermined pressure, and the controller calculates the first operation information when the detected current value of the first power module is greater than or equal to a first value, and calculates the second operation information when the detected current value of the first power module is less than the first value.

In addition, in order to achieve the objectives of the present disclosure, the present disclosure provides a cleaning unit, including a columnar body portion in which a rotation guide hole is disposed on an outer peripheral surface thereof; a shaft provided to reciprocate a predetermined distance in a length direction in a hollow disposed in the body; a driving portion protruding from the shaft in a radial direction, and having an outer peripheral surface inclined radially outward along the length direction; a brush portion having one side provided on an outer peripheral surface of the body portion along the length direction to rotate with the one side as a rotation axis thereof; and a driven portion extending from the brush portion into the body portion through the rotation guide hole, wherein the driven portion has an inclined portion in contact with the outer peripheral surface, and as the shaft reciprocates, the driven portion is rotated by the outer peripheral surface, and the brush portion is rotated by the rotation of the driven portion.

Furthermore, the brush portion and the driven portion extending from the brush portion may be disposed in plurality along a circumferential direction of the body portion.

Furthermore, the driving portion may be disposed in plurality along the length direction on the shaft, and the driven portion may be disposed in plurality along the length direction of the brush portion.

Moreover, a distance between the shaft and the other end of the brush portion may become the minimum when the shaft is maximally moved toward one side of the body portion, and become the maximum when the shaft is maximally moved toward the other side opposite to the one side.

Advantageous Effects of Invention

According to the present disclosure, the following effects may be derived.

First, in the present disclosure, a cam structure that converts a longitudinal movement of a shaft into a rotational movement of a brush portion may be employed, thereby varying a rotation radius of the brush portion according to a floor environment. Through this, even when a cleaner is spaced apart from a surface, such as in a carpet environment, the rotation radius of the brush may be extended to stroke the surface. That is, the cleaning performance of the cleaner may be maintained in various floor environments.

Furthermore, a user may easily vary the radius of rotation of the brush without touching dust by hand in the process of varying the radius of rotation of the brush. Through this, the user may clean various floor environments while maintaining cleanliness.

In addition, a bearing may be provided between a shaft receiving portion and a shaft, thereby pushing or pulling the shaft while an agitator rotates. Through this, the rotation radius of the brush portion may be extended or reduced.

Moreover, a fixed brush portion may be disposed between rotating brush portions, thereby always applying a stroke at an appropriate pressure to a surface to be cleaned.

Besides, the brush portion may include a first brush and a second brush inclined by a predetermined angle to each other, in which the first brush and the second brush are disposed to have different lengths, thereby always applying a stroke at an appropriate pressure to the surface to be cleaned.

Furthermore, the rotation radius of the brush portion is automatically controlled to extend according to a current value flowing through a first power module that rotates the agitator. Through this, when the cleaner is automatically operated, the rotation radius of the brush portion may be controlled to extend in the carpet environment.

MODE FOR THE INVENTION

First, prior to describing an agitator according to the present disclosure, a cleaner in the related art to which an agitator can be coupled will be described.

Figure 1:
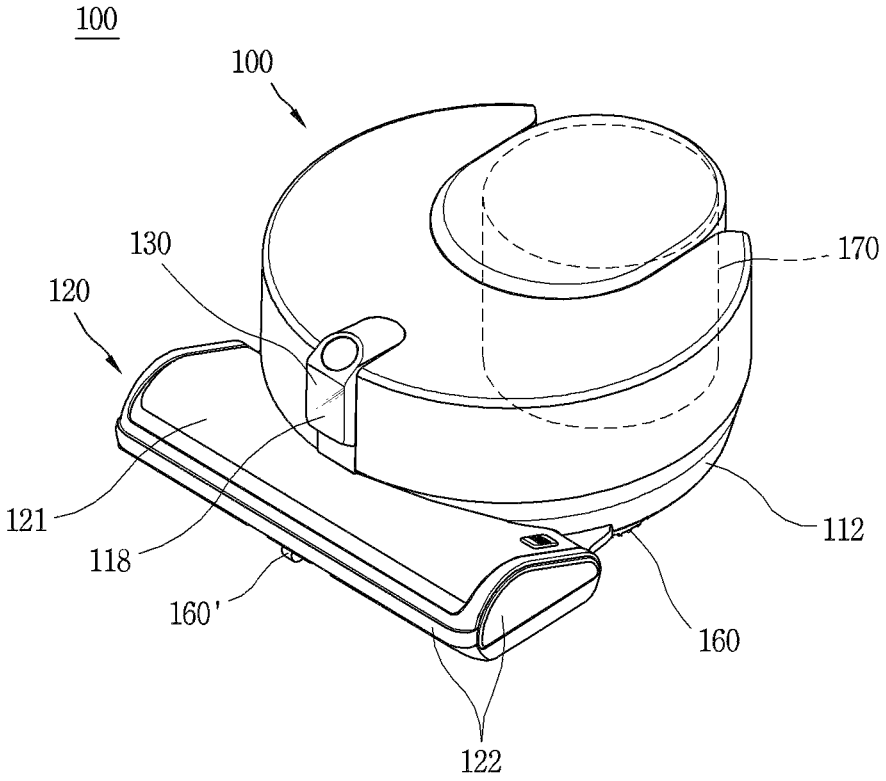
FIG. 1 is a perspective view illustrating a robot cleaner in the related art.
Figure 2:
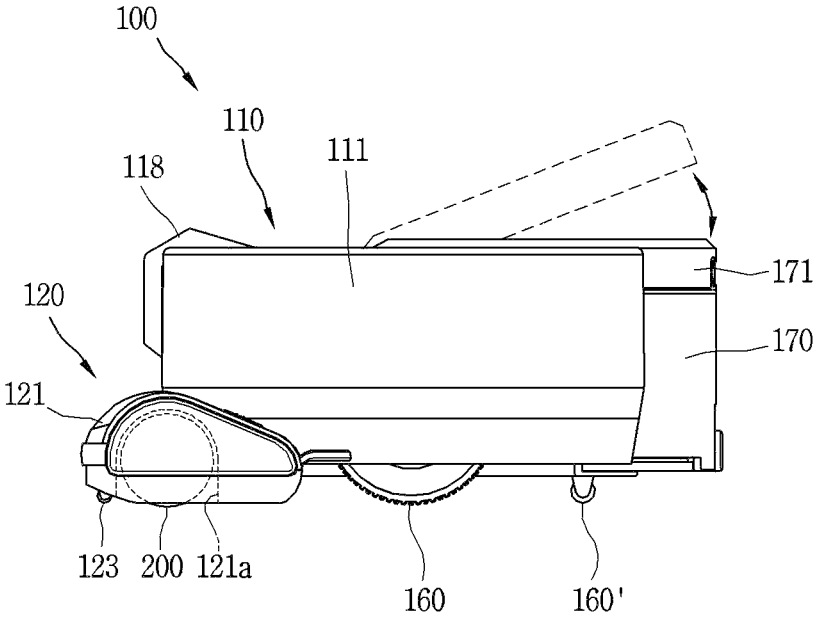
FIG. 2 is a side view of the robot cleaner illustrated in FIG. 1.

FIG. 1 is a perspective view illustrating an example of a cleaner in the related art, and FIG. 2 is a side view of the cleaner illustrated in FIG. 1.

A robot cleaner 100 may be configured to perform a function of mopping a floor as well as a function of sucking dust on the floor. To this end, the robot cleaner 100 includes a cleaner body 110 and a suction nozzle module 120.

The cleaner body 110 and the suction nozzle module 120 define an exterior of the robot cleaner 100. Various parts including a controller (not shown) for controlling the robot cleaner 100 are embedded or mounted in the robot cleaner 100. Furthermore, various parts for cleaning an area to be cleaned are mounted in the suction nozzle module 120.

An exterior of the cleaner body 110 is defined by an outer cover 111 and a base body 112.

The outer cover 111 and the base body 112 are coupled to each other to define the exterior of the cleaner body 110. The base body 112 defines a bottom portion of the cleaner body 110 and is configured to accommodate the components of the robot cleaner 100. In addition, the outer cover 111 is coupled to an upper portion of the base body 112.

The cleaner body 110 is provided with wheels 160, 160' for driving the robot cleaner 100. The wheels 160, 160' may be provided at a lower portion of the cleaner body 110 or the suction nozzle module 120. The robot cleaner 100 may move or rotate back and forth, left and right by the wheels 160, 160'.

For an example, when the robot cleaner 100 has an autonomous driving function, the wheels 160, 160' may be configured as a wheel module 160 that is rotated by receiving a driving force from a drive motor. For another example, when the cleaner body 110 is moved by a user manipulation, the wheels 160, 160' may be configured to have only a rolling function with respect to a typical floor.

An auxiliary wheel 160' may be additionally provided in the cleaner body 110. The auxiliary wheel 160' supports the cleaner body 110 together with the wheel module 160, and may be configured to enable only passive rotation. The auxiliary wheel 160' is configured to support the driving of the robot cleaner 100 by the wheel module 160.

A dust container 170 is mounted at a rear of the cleaner body 110. The cleaner body 110 may have a partially recessed shape to accommodate the dust container 170 while maintaining a circular exterior. The dust container 170 may include at least one of a filter and a cyclone for filtering dust and foreign substances in the sucked air.

The robot cleaner 100 may include a dust container cover 171 covering the dust container 170. In a state in which the dust container cover 171 is disposed to cover an upper surface of the dust container 170, the dust container cover 171 may restrain the dust container. Accordingly, the dust container cover 171 may prevent the dust container 170 from being arbitrarily separated from the cleaner body 110.

FIG. 2 illustrates that the dust container cover 171 is hinge-coupled to the cleaner body 110 in a rotatable manner. The dust container cover 171 may be fixed to the dust container 170 or the cleaner body 110 to maintain a state of covering an upper surface of the dust container 170.

When the robot cleaner 100 has an autonomous driving function like the robot cleaner, a sensing unit 118 for sensing a surrounding situation may be provided in the cleaner body 110. The controller configured with a main printed circuit board (not shown) may sense an obstacle, sense a terrain feature, or electronically generate a map of a driving area through the sensing unit 118.

The suction nozzle module 120 is coupled to a front of the cleaner body 110 in a protruding shape. An exterior of the suction nozzle module 120 is defined by a module mounting housing 121, and an agitator mounting portion 121*a* is disposed at inner side of the module mounting housing 121. An agitator 200 is detachably mounted to the agitator mounting portion 121*a*.

A bumper switch 122 that detects a physical collision may be provided at an outer side of the suction nozzle module 120.

In this drawing, it is shown that the bumper switch 122 is provided in the suction nozzle module 120. The bumper switch 122 may be disposed at a front of the suction nozzle module 120, and in some cases, may be disposed at both lateral sides as well as at the front thereof as illustrated.

As illustrated, when the suction nozzle module 120 is disposed in a shape protruding from the cleaner body 110, the above-described auxiliary wheel 160' for stable driving of the robot cleaner 100 may also be provided at the bottom of the suction nozzle module 120.

The agitator 200 detachably mounted to the agitator mounting portion 121*a* is configured to clean the area to be cleaned. Dust and foreign substances in the air sucked in through the agitator 200 are separated from the air by a filter or a cyclone provided in the cleaner body or dust container, and are collected in the dust container 170. Furthermore, the air separated from the dust and foreign substances is discharged to an outside of the cleaner body 110. An intake passage (not shown) that guides a flow of the air from the agitator mounting portion 121*a* to the dust container 170 may be disposed inside the cleaner body 110. In addition, an exhaust passage (not shown) that guides a flow of the air from the dust container 170 to the outside of the cleaner body 110 may be disposed inside the cleaner body 110.

The cleaner illustrated in FIGS. 1 and 2 illustrates a position at which the agitator 200, 300 according to the present disclosure is provided, and briefly describe the cleaner in the related art in which the agitator 200, 300 is coupled thereto to operate. The agitator 200, 300 according to the present disclosure may be employed not only in an automatically operated robot cleaner, but also in a cleaner directly manipulated by the user.

Hereinafter, a cleaning unit having an agitator capable of varying a length of a brush according to the present disclosure will be described.

In the following description, the description of some components will be omitted to clarify the features of the present disclosure.

Figure 3:
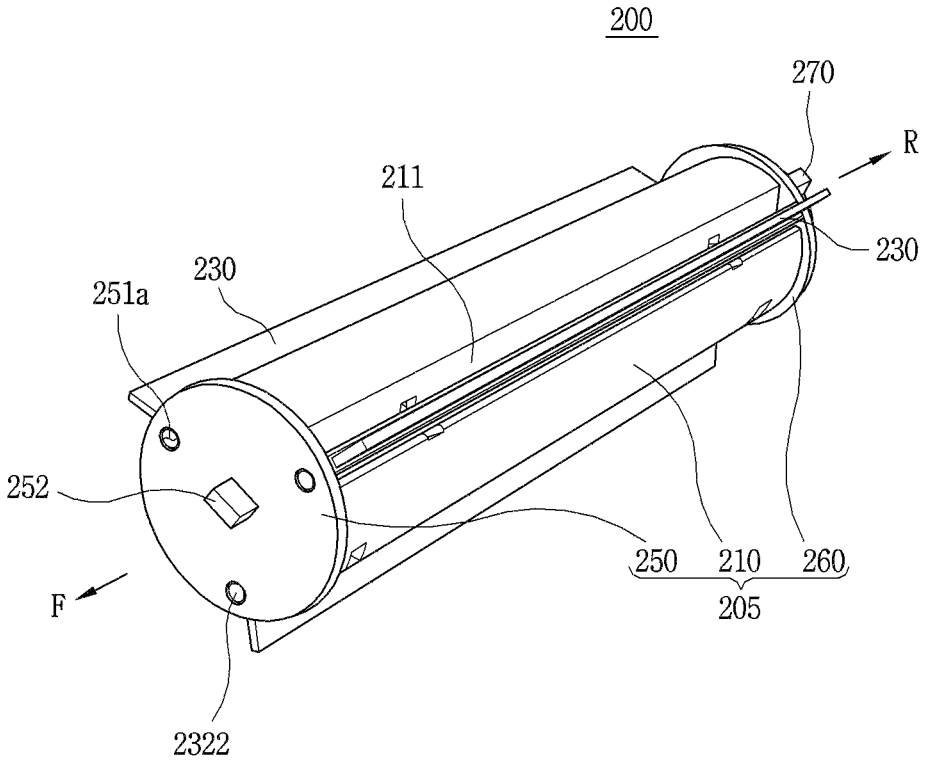
FIG. 3 is a perspective view illustrating an agitator according to an embodiment of the present disclosure.

FIG. 3 is a perspective view illustrating an embodiment of the agitator according to the present disclosure.

Prior to describing the configuration of the agitator 200 according to the present disclosure, directions used below will be defined.

The term "length direction" used below denotes an axial direction of a shaft 220 (see FIG. 4) to be described later. That is, the "length direction" denotes a direction from a first end cap 250 to a second end cap 260 and a direction from the second end cap 260 to the first end cap 250.

In addition, the term "radial direction" used below denotes a direction with the shortest distance from any one point on a central axis extended by the shaft 220 (see FIG. 4) to any one point on an outer peripheral surface of a body member 210 positioned on a plane perpendicular to the central axis to be described later.

In addition, the term "circumferential direction" used below denotes a rotational direction when an imaginary line perpendicular to a central axis of the shaft 220 (see FIG. 4) to be described later is rotated along the central axis.

Furthermore, the term "front (F)" used below denotes a direction in which the shaft 220 (see FIG. 4) moves when a brush portion 230 is extended. That is, it denotes a direction in which the shaft 220 approaches the first end cap 250.

In addition, the term "rear (R)" used below denotes a direction in which the shaft 220 (see FIG. 4) moves when the brush portion 230 is returned. That is, it denotes a direction in which the shaft 220 moves away from the first end cap 250.

Referring to FIG. 3, the agitator 200 of the present disclosure includes a body portion 205, the shaft 220 (see FIG. 4), the brush portion 230, and a shaft receiving portion 270.

The body portion 205 includes the body member 210, the first end cap 250 and the second end cap 260.

The body member 210 may be defined in a hollow shape with both sides open. The shaft 220 (see FIG. 4) to be described later is inserted into a hollow of the body member 210 in a length direction. The first end cap 250 and the second end cap 260 are respectively fitted and coupled to the both open ends of the body member.

Both sides of the shaft 220 (see FIG. 4) are slidably coupled to the first end cap 250 and the second end cap 260 in the length direction. Through this, the shaft 220 (see FIG. 4) may reciprocate in the length direction within the body portion 205. In this regard, it will be described in detail later.

Figure 4:
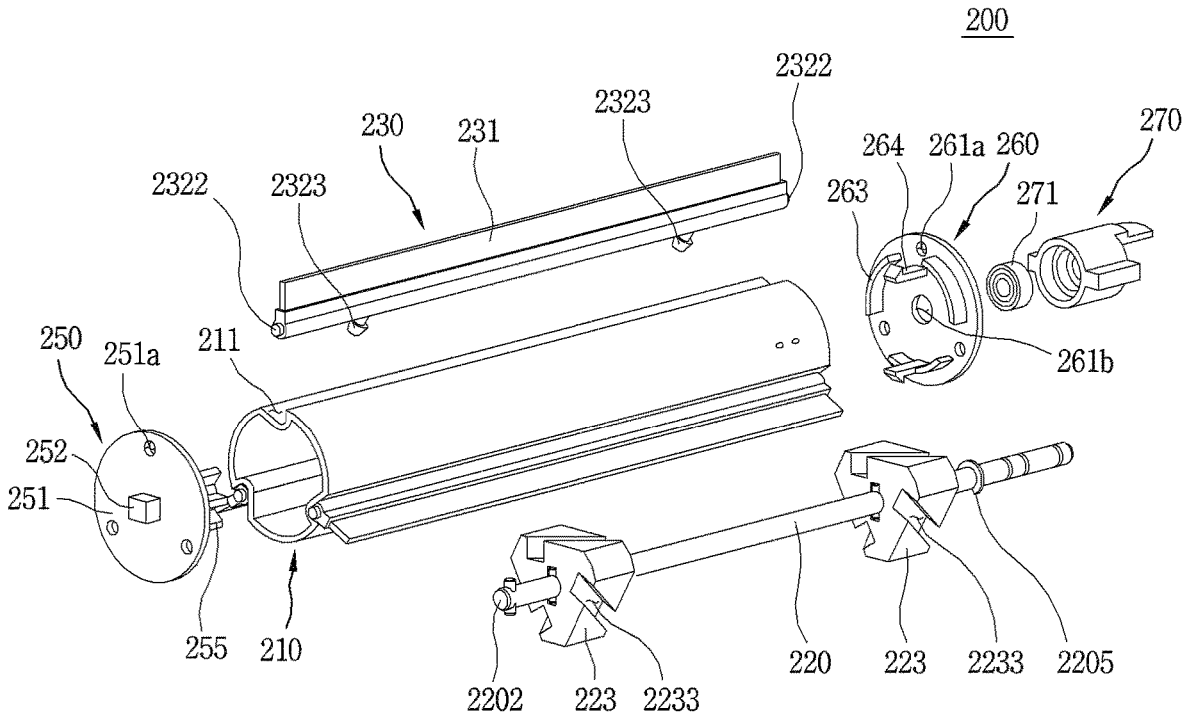
FIG. 4 is an exploded view of the agitator illustrated in FIG. 3.

In other words, the first end cap 250 accommodates a front side of the shaft 220 (see FIG. 4). Furthermore, at the same time, the first end cap 250 is fitted to a front side end portion of the body member 210 to cover the shaft.

The second end cap 260 accommodates a rear side of the shaft 220. Furthermore, at the same time, the second end cap 260 is fitted to a rear side end portion of the body member 210 to cover the shaft.

The other side of the shaft 220 is connected to the shaft receiving portion 270 by passing through the second end cap 260.

A recess groove 211 is disposed to be depressed by a predetermined length along the length direction on an outer peripheral surface of the body member 210. The brush portion 230 is provided in the recess groove 211 along the length direction.

The brush portion 230 rotates with one side thereof accommodated in the recess groove 211 as a rotation axis. In this regard, it will be described in detail later.

Rotation protrusions 2322 protrude from both end portions of the one side accommodated in the recess groove 211. Receiving holes 251*a*, 261*a* rotatably coupled to the rotation protrusion 2322 are disposed in the first end cap 250 and the second end cap 260, respectively.

The brush portion 230 is coupled to the body member 210 through the above-described coupling structure. In addition, the brush portion 230 may be rotated through the above-described coupling structure.

FIG. 4 is an exploded view of the agitator illustrated in FIG. 3.

With reference to FIG. 4, the body member 210, the shaft 220, the brush portion 230, a power transmission unit 240, the first end cap 250, and the second end cap, and the shaft receiving portion 270 according to an embodiment of the present disclosure 260 will be described.

First, the body member 210 according to the present disclosure will be described.

The body member 210 is disposed in a hollow shape with both ends open. One side of the brush portion 230 may be provided on an outer peripheral surface of the body member 210 in the length direction.

The recess groove 211 may be disposed on the outer peripheral surface of the body member 210 along the length direction.

The recess groove 211 may be disposed to be recessed along the length direction from the outer peripheral surface of the body member 210. A portion provided with one side of the brush portion 230 is disposed to be recessed on a portion provided with the brush portion 230.

The recess groove 211 provides a space in which one side of the brush portion 230 can rotate.

A plurality of recess grooves 211 may be disposed along a circumferential direction. For example, in case where three brush portions 230 are disposed, three recess grooves 211 are also disposed to accommodate the brush portions 230, respectively.

A rotation guide hole 213 is disposed in the recess groove 211.

A coupling relationship with the other components of the body member 210 is as follows.

The shaft 220 is inserted into a hollow of the body member 210 in the length direction. Then, the brush portion 230 is provided in the recess groove 211 of the body member 210. In addition, the first end cap 250 and the second end cap 260 are respectively fitted to and inserted into both open ends of the body member 210.

Next, the shaft 220 according to the present disclosure will be described.

The shaft 220 is accommodated in the hollow of the body member 210 in the length direction. Both sides of the shaft 220 are slidably coupled to the first and second end caps 250 260, respectively, in the length direction. Through this, the shaft 220 may reciprocate in the length direction within the body member 210.

A driving portion 223 extends in a radial direction on an outer peripheral surface of the shaft 220. The driving portion 223 is coupled to an outer peripheral surface of the shaft 220. Furthermore, the shaft 220 and the driving portion 223 may be integrated into a single body.

The driving portion 223 may be defined in a polygonal columnar shape. A rotation guide groove 2233 is disposed on a radially outer side of the driving portion 223. The rotation guide groove 2233 extends at a predetermined angle with respect to the length direction of the shaft 220.

A driven portion 2323 to be described later is inserted into the rotation guide groove 2233. As the shaft 220 reciprocates along the length direction together with the driving portion 223, the driven portion 2323 is guided in the rotation guide groove 2233. Through this, the driven portion 2323 is rotated with one side of the brush portion 230 as a rotation axis. In this regard, it will be described in detail later.

The rotation guide groove 2233 may be disposed in plurality on a radially outer side of the driving portion 223 along a circumferential direction. The driven portion 2323 inserted into the rotation guide groove 2233 may also be disposed in plurality along a circumferential direction of the shaft 220. That is, the brush portion 230 may be disposed in plurality along the circumferential direction.

In addition, the driving portion 223 may be disposed in plurality along the length direction of the shaft 220. The driven portion 2323 inserted into the rotation guide groove 2233 may also be disposed in plurality along the length direction of the shaft 220. That is, the driven portion 2323 may be disposed in plurality on the brush portion 230 in the length direction.

A front side end portion of the shaft 220 is slidably coupled to the first end cap 250. A rear side of the shaft 220 is coupled to the second end cap 260 by passing therethrough. That is, the shaft 220 passes through the second end cap 260 and extends to a rear side thereof, and is slidably inserted into the shaft receiving hole 261*b* of the second end cap 260.

A rear side end portion of the shaft 220 is connected to the shaft receiving portion 270.

In this drawing, while the shaft 220 is illustrated in a cylindrical shape, the shaft 220 may also be defined in a polygonal columnar shape.

Here, the polygonal columnar shape does not necessarily include only a shape made of a straight line, but a shape combined with a straight line and a curve, and may include all other shapes other than the cylindrical shape.

However, in order to efficiently rotate the shaft 220, a rotation axis and a center of mass of the shaft 220 are preferably defined to coincide with each other.

In addition, the shaft 220 may include a plurality of pins 2202 and an E-ring 2205. The pin 2202 passes through the shaft 220 in a direction crossing the length direction of the shaft 220. The E-ring 2205 is configured with an annular yoke portion that is partially open and a teeth portion extending radially inward from the yoke portion.

A thin groove recessed along the circumferential direction is formed in the shaft 220. In the groove, the E-ring 2205 is inserted into the groove through an open portion thereof.

The pin 2202 and the E-ring 2205 limit a reciprocating distance of the shaft 220. Furthermore, the pin 2202 and the E-ring 2205 fix the driving portion 223 and the shaft receiving portion 270 coupled to the shaft 220 in the length direction. In this regard, it will be described in detail later.

Next, the brush portion 230 according to an embodiment of the present disclosure will be described.

The brush portion 230 is provided on an outer peripheral surface of the body member 210 along the length direction. The recess groove 211 of the body member 210 provided with the brush portion 230 is disposed to be recessed from the outer peripheral surface.

The brush portion 230 includes a brush holder 232 and a brush 231 inserted into the brush holder 232. In an embodiment of the present disclosure, the brush 231 and the brush holder 232 may be disposed to have substantially the same length in the length direction. In addition, the brush holder 232 may be disposed to have substantially the same length as the body member 210 in the length direction.

The brush 231 extends along the length direction. The brush 231 may be in the form of a bundle of a plurality of brushes or in the form of a rubber plate. The brush 231 hits a surface to be cleaned while rotating with the shaft 220 as a rotation axis. Through this, it may be possible to float or pick up dust or foreign substances placed on the surface to be cleaned.

The brush holder 232 extends along the length direction. A groove into which the brush 231 is inserted is disposed at one side of the brush holder 232, and a driven portion 2323 is disposed at the other side opposite to the one side.

The driven portion 2323 extends toward the driving portion 223. An end portion of the driven portion 2323 is inserted into the driving portion 223. The end portion may be defined in a spherical shape. However, it is not necessarily limited to a spherical shape, and may be any shape that can be inserted into and engaged with the rotation guide groove 2233 of the driving portion 223.

The rotation protrusions 2322 are extended at both end portions of the brush holder 232 in the length direction. The rotation protrusion receiving holes 251*a*, 261*a* are disposed in the first end plate 251 and the second end plate 261. The rotation protrusion 2322 is rotatably coupled to the rotation protrusion receiving holes 251*a*, 261*a*.

The brush portion 230 is coupled to the body member 210 through the coupling structure. The brush portion 230 is rotated with one side disposed with the rotation protrusion receiving holes 251*a*, 261*a* as a rotation axis.

In other words, the brush holder 232 is rotated with respect to an axis passing through the rotation protrusions 2322 disposed at both end portions thereof. The brush 231 is inserted into one side of the brush holder 232, and the brush 231 is rotated with respect to an axis passing through the rotation protrusion 2322. Furthermore, the driven portion 2323 disposed on the other side of the brush holder 232 is also rotated with respect to an axis passing through the rotation protrusion 2322.

That is, the brush 231 and the driven portion 2323 are rotated with respect to the axis passing through the rotation protrusion 2322.

As the shaft 220 reciprocates, the driven portion 2323 is guided to rotate by the rotation guide groove 2233, and the brush 231 is rotated by the rotation of the driven portion 2323. In this regard, it will be described in detail later.

Next, the first end cap 250 according to an embodiment of the present disclosure will be described.

The first end cap 250 includes the first end plate 251. The first end plate 251 is defined in a circular plate shape. A power transmission portion 252 protrudes from a front side of the first end plate 251, and a first fitting portion 253 is disposed at a rear side thereof.

The first fitting portion 253 is disposed along the circumferential direction to be engaged with an inner peripheral surface of the body member 210. In addition, a first coupling protrusion 254 having an elastic force protrudes from a rear side of the first end plate 251.

When the first end cap 250 is inserted into the body member 210, an end portion of the first coupling protrusion 254 is caught in an end cap coupling hole 215 disposed on an outer peripheral surface of the body member 210. Through this, the first end cap 250 is coupled to one end portion of the body member 210 to cover the body member 210.

The power transmission portion 252 is coupled to the first power module. A rotational force of the first power module is transmitted to the agitator 200 by the power transmission portion 252.

Next, the second end cap 260 according to an embodiment of the present disclosure will be described.

The second end cap 260 includes the second end plate 261. The second end plate 261 is defined in a circular plate shape. A second fitting portion 263 is disposed at a front side of the second end plate 261.

The second fitting portion 263 is disposed along a circumferential direction to be engaged with an inner peripheral surface of the body member 210. In addition, a second coupling protrusion 264 having an elastic force protrudes from the front side of the second end plate 261.

When the second end cap 260 is inserted into the body member 210, an end portion of the second coupling protrusion 264 is caught in the end cap coupling hole 215 disposed on the outer peripheral surface of the body member 210. Through this, the second end cap 260 is coupled to a rear end portion of the body member 210 to cover the body member 210.

The shaft receiving hole 261*b* is disposed at the center of the second end plate 261 by passing therethrough. A rear side of the shaft 220 is slidably coupled to the shaft receiving hole 261*b*. That is, the shaft receiving hole 261*b* guides a longitudinal movement of the shaft 220.

Next, the shaft receiving portion 270 according to an embodiment of the present disclosure will be described.

The shaft receiving portion 270 is coupled to a rear end portion of the shaft 220.

A bearing receiving portion 270*b* recessed by a predetermined length from the front side toward the rear side is disposed in the shaft receiving portion 270. In addition, a shaft coupling hole 270*a* is disposed at a rear side of the bearing receiving portion 270*b* by passing therethrough.

A rear end portion of the shaft 220 is rotatably coupled to the shaft coupling hole 270*a*. Furthermore, the rear end portion of the shaft 220 is accommodated in the bearing receiving portion 270*b*. Here, a bearing 271 is inserted between the rear end portion of the shaft 220 and the bearing receiving portion 270*b*. In an embodiment of the present disclosure, a ball bearing or the like may be used for the bearing 271. As the shaft 220 rotates together with an inner ring of the bearing 271, the shaft 220 is rotated in the shaft receiving portion 270.

The shaft receiving portion 270 is positioned between a plurality of E-rings 2205 protruding from an outer peripheral surface of the shaft 220. Through this, the shaft receiving portion 270 is fixed in the length direction on the shaft 220.

A rear side of the shaft receiving portion 270 is coupled to a second power module. The second power module pushes the shaft receiving portion 270 to the front side or pulls the shaft receiving portion 270 to the rear side. That is, a reciprocating movement of the shaft 220 is controlled.

Hereinafter, with reference to FIGS. 5A, 5B and 5C, the shaft 220 according to an embodiment of the present disclosure will be described in detail.

Figure 5A:
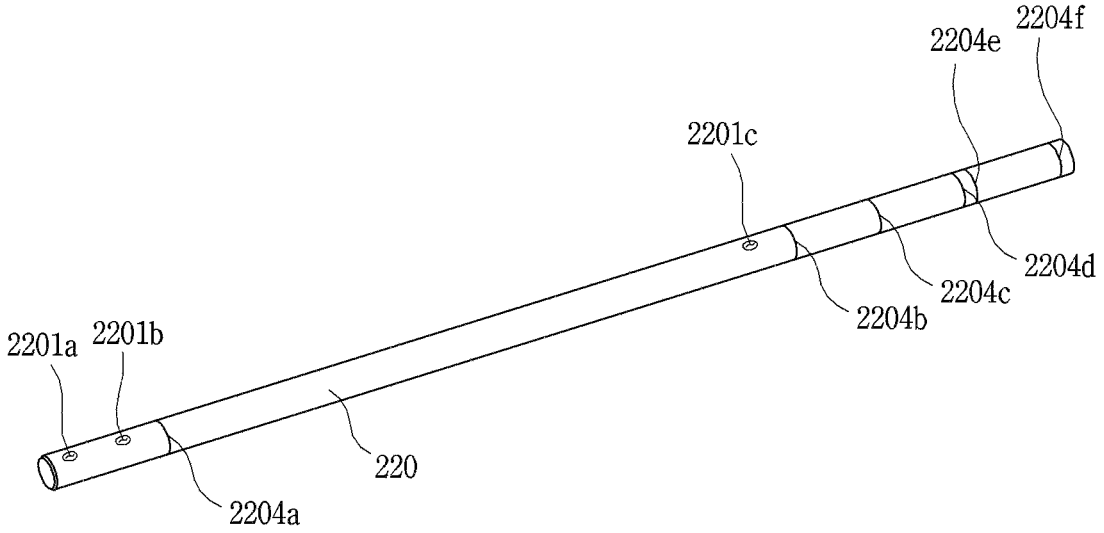
FIG. 5A is a perspective view of the shaft illustrated in FIG. 4.

FIG. 5A is a perspective view of the shaft illustrated in FIG. 4.

The shaft 220 is defined in a long cylindrical shape. Furthermore, a pin receiving hole 2201 and an E-ring receiving groove 2204 are disposed on the shaft 220.

The pin receiving hole 2201 passes through the shaft 220 in a direction crossing the length direction of the shaft 220. The pin receiving hole 2201 may be disposed in plurality along the length direction. In an embodiment of the present disclosure, a first pin receiving hole 2201*a*, a second pin receiving hole 2201*b* and a third pin receiving hole 2201*c* are sequentially disposed along the length direction.

The E-ring receiving groove 2204 is recessed along the circumferential direction on the outer peripheral surface of the shaft 220. The E-ring receiving groove 2204 may be disposed in plurality along the length direction. In an embodiment of the present disclosure, a first E-ring receiving groove 2204*a*, a second E-ring receiving groove 2204*b*, a third E-ring receiving groove 2204*c*, a fourth E-ring receiving groove 2204*d*, a fifth E-ring receiving groove 2204*e* and a sixth E-ring receiving groove 2204*f* are sequentially positioned along the length direction.

Figure 5B:
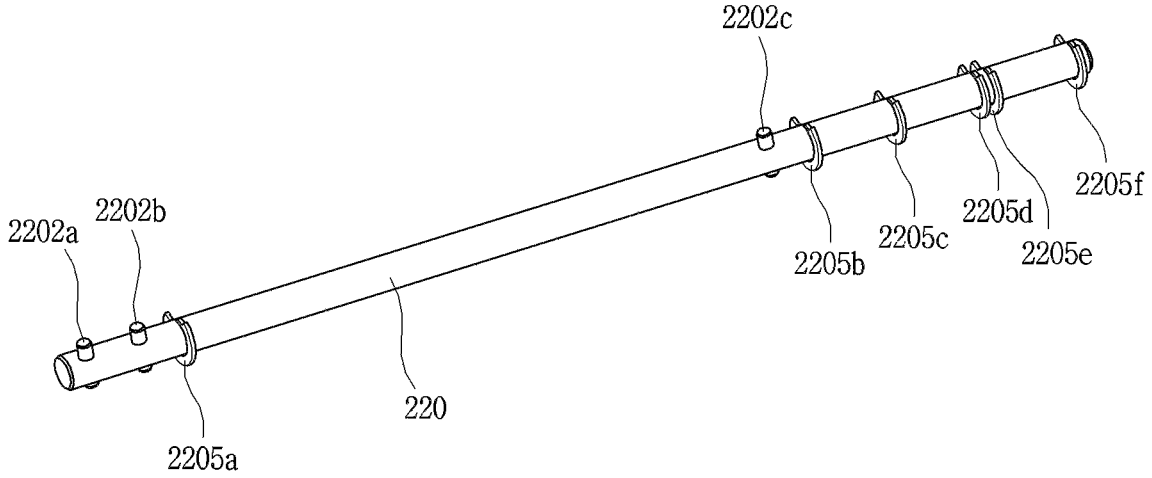
FIG. 5B is a perspective view illustrating a state in which a pin and an E-ring are coupled to the shaft illustrated in FIG. 5A.

FIG. 5B is a perspective view illustrating a state in which a pin and an E-ring are coupled to the shaft illustrated in FIG. 5A.

A first pin 2202*a*, a second pin 2202*b*, and a third pin 2202*c* sequentially is inserted into the first pin receiving hole 2201*a*, the second pin receiving hole 2201*b*, and the third pin receiving hole 2201*c*. In the coupled state, both end portions of each pin 2202 protrude from both end portions of the receiving hole 2201.

A first E-ring 2205*a*, a second E-ring 2205*b*, a third E-ring 2205*c*, a fourth E-ring 2205*d*, a fifth E-ring 2205*e*, and a sixth E-ring 2205*f* are coupled to the first E-ring receiving groove 2204*a*, the second E-ring receiving groove 2204*b*, the third E-ring receiving groove 2204*c*, the fourth E-ring receiving groove 2204*d*, the fifth E-ring receiving groove 2204*e*, and the sixth E-ring receiving groove 2204*f*, respectively.

The E-ring 2205 is configured with an annular yoke portion that is partially open and a teeth portion extending radially inward from the yoke portion.

The E-ring 2205 is inserted into the E-ring receiving groove 2204 through a portion that is partially open.

Figure 5C:
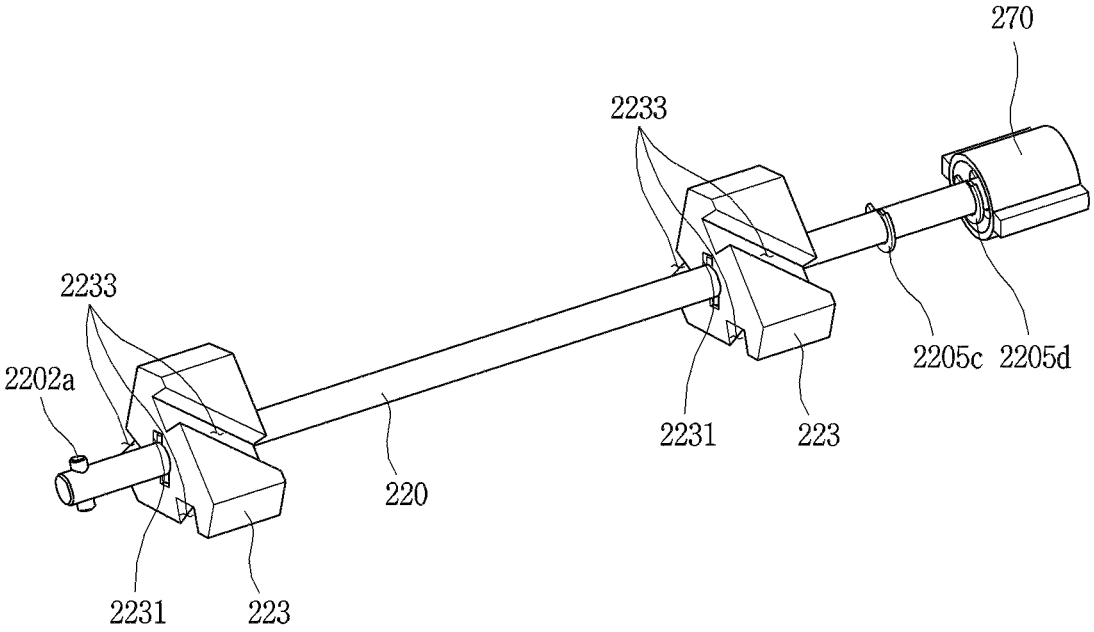
FIG. 5C is a perspective view illustrating a state in which a driving portion is coupled to the shaft illustrated in FIG. 5B.

FIG. 5C is a perspective view illustrating a state in which a driving portion is coupled to the shaft illustrated in FIG. 5B.

The driving portion 223 may be formed in a polygonal columnar shape. The rotation guide groove 2233 is disposed on a radially outer side of the driving portion 223. The rotation guide groove 2233 extends while being inclined by a predetermined angle from the length direction of the shaft 220.

A through hole is disposed at the center of the driving portion 223 to accommodate the shaft 220. In addition, a pin coupling hole 2231 engaged with the pin 2202 is disposed to be recessed at a front side of the driving portion 223.

Hereinafter, a method of coupling between the driving portion 223 and the shaft will be described.

The driving portion 223 may be disposed in plurality along the length direction of the shaft 220. In an embodiment of the present disclosure, two driving portions 223 are coupled to the shaft 220.

A coupling position of the driving portion 223 is determined by the positions of the pin 2202 and the E-ring 2205.

First, the driving portion 223 is inserted from a rear side of the shaft 220 to a front side thereof through the through hole. When the driving portion 223 is inserted to a position where the second pin 2202*b* is disposed, the second pin 2202*b* is inserted into the pin coupling hole 2231. Then, from a rear side of the driving portion 223, the first E-ring 2205*a* is inserted into the first E-ring receiving groove 2204*a*.

The driving portion 223 is pushed from a front side to a rear side by the second pin 2202*b*, and is pushed toward the front side by the first E-ring 2205*a* from the rear side. Through this, the driving portion 223 is fixed in the length direction. Furthermore, since the pin coupling hole 2231 of the driving portion 223 is engaged with the second pin 2202*b*, a rotational force of the shaft 220 is transmitted to the driving portion 223. Through this, the shaft 220 and the driving portion 223 rotate together.

The driving portion 223 is also positioned between the third pin 2202*c* and the second E-ring 2205*b*, and the driving portion 223 is coupled to the shaft 220 in the same manner as described above.

The driving portion 223 may be integrated into the shaft 220, and is not limited by the above-described coupling method.

The first pin 2202*a* inserted into a front side of the shaft 220 is engaged with the shaft guide portion 255 of the first end cap 250 to be described later. When the body member 210 is rotated by the first power transmission portion, the first pin 2202*a* is rotated together with the shaft guide portion 255 of the first end cap 250. Through this, the first pin 2202*a* transmits a rotational force of the body member 210 to the shaft 220.

The third E-ring 2205*c* and the fourth E-ring 2205*d* are positioned with the second end cap 260 interposed therebetween. Specifically, the third E-ring 2205*c* and the fourth E-ring 2205*d* are positioned with the second end plate 261 interposed therebetween.

When the shaft 220 moves to a front side, a front side surface of the fourth E-ring 2205*d* pushes a rear side surface of the second end plate 261. Through this, the movement of the shaft 220 to the front side is stopped.

When the shaft 220 moves to a rear side, a rear side surface of the third E-ring 2205*d* pushes a front side surface of the second end plate 261. Through this, the movement of the shaft 220 to the rear side is stopped.

That is, the third E-ring 2205*c* and the fourth E-ring 2205*d* limit a reciprocating distance of the shaft 220.

The fifth E-ring 2205*e* and the sixth E-ring 2205*f* are positioned at front and rear sides of the shaft receiving portion 270, respectively. Through this, the shaft receiving portion 270 is fixed in the length direction.

Figure 6:
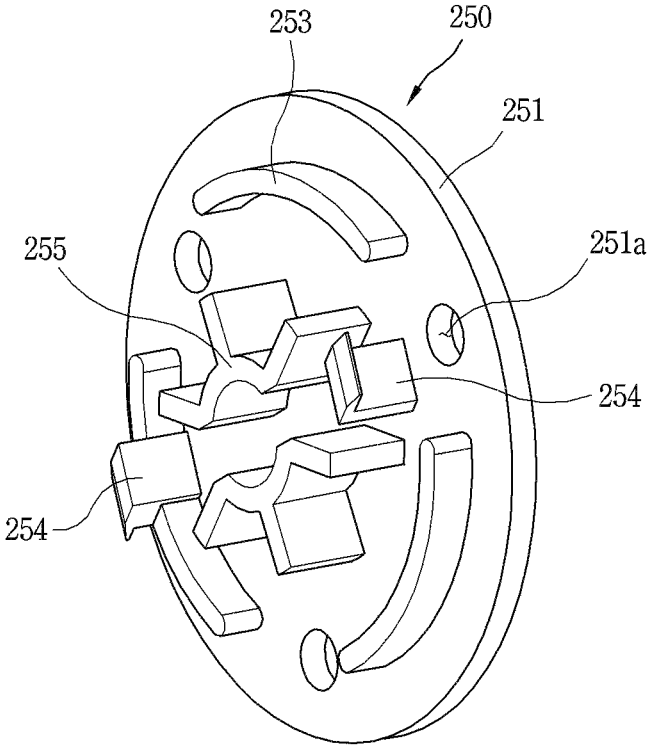
FIG. 6 is a perspective view illustrating the second end cap illustrated in FIG. 4.

FIG. 6 is a perspective view illustrating the first end cap illustrated in FIG. 4.

Referring to FIG. 6, the shaft guide portion 255 protrudes from the first end cap 250.

The shaft guide portion 255 may be defined in a cylindrical shape. However, one side of the shaft guide portion 255 is open to accommodate a front side end portion of the shaft 220, and a central portion thereof is passed therethrough along a radial direction to accommodate the first pin 2202*a*.

The front side end portion of the shaft 220 to which the first pin 2202*a* is coupled is slidably coupled to the shaft guide portion 255. That is, the shaft guide portion 255 guides a reciprocating movement of the shaft 220. In addition, when the first end cap 250 rotates, the shaft guide portion 255 and the front side end portion of the shaft 220 are engaged with each other to rotate together.

Figure 7:
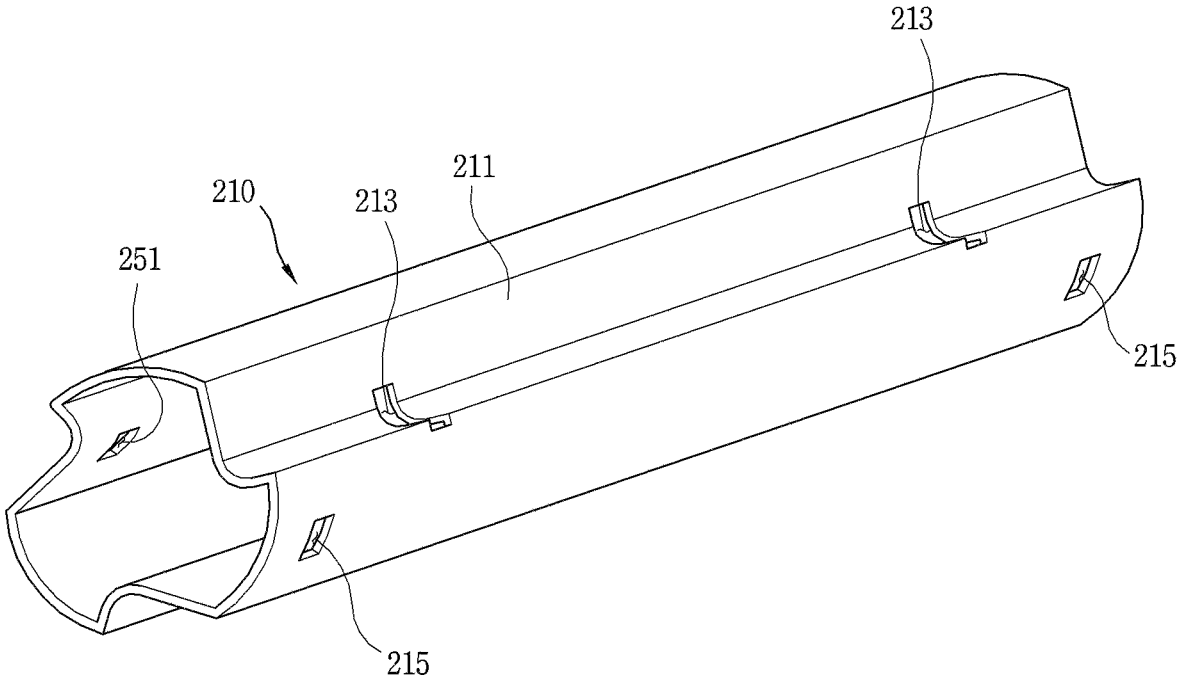
FIG. 7 is a perspective view illustrating a body member illustrated in FIG. 4.

FIG. 7 is a perspective view illustrating the body member illustrated in FIG. 4.

Referring to FIG. 7, the body member 210 is defined in a cylindrical shape with both sides open. Furthermore, the recess groove 211 recessed along the length direction to accommodate the brush portion 230 is disposed on the outer peripheral surface. The recess groove 211 may be disposed in plurality along a circumferential direction.

The rotation guide hole 213 is disposed in the recess groove 211 by passing therethrough. The driven portion 2323 of the brush portion 230 is inserted into the body member 210 through the rotation guide hole 213. In addition, the rotation guide hole 213 provides a space in which the driven portion 2323 is rotatable.

The rotation guide holes 213 may be disposed in plurality along the length direction. In other words, when the driven portion 2323 is disposed in plurality along the length direction, the rotation guide hole 213 may be disposed with the same number as that of the driven portion 2323.

In addition, the end cap coupling hole 215 is disposed on an outer peripheral surface of the body member 210. As the end portions of the first coupling protrusion 254 and the second coupling protrusion 264 are caught in the end cap coupling hole 215, the first end cap 250 and the second end cap 260 are coupled to the body member 210.

Figure 8:
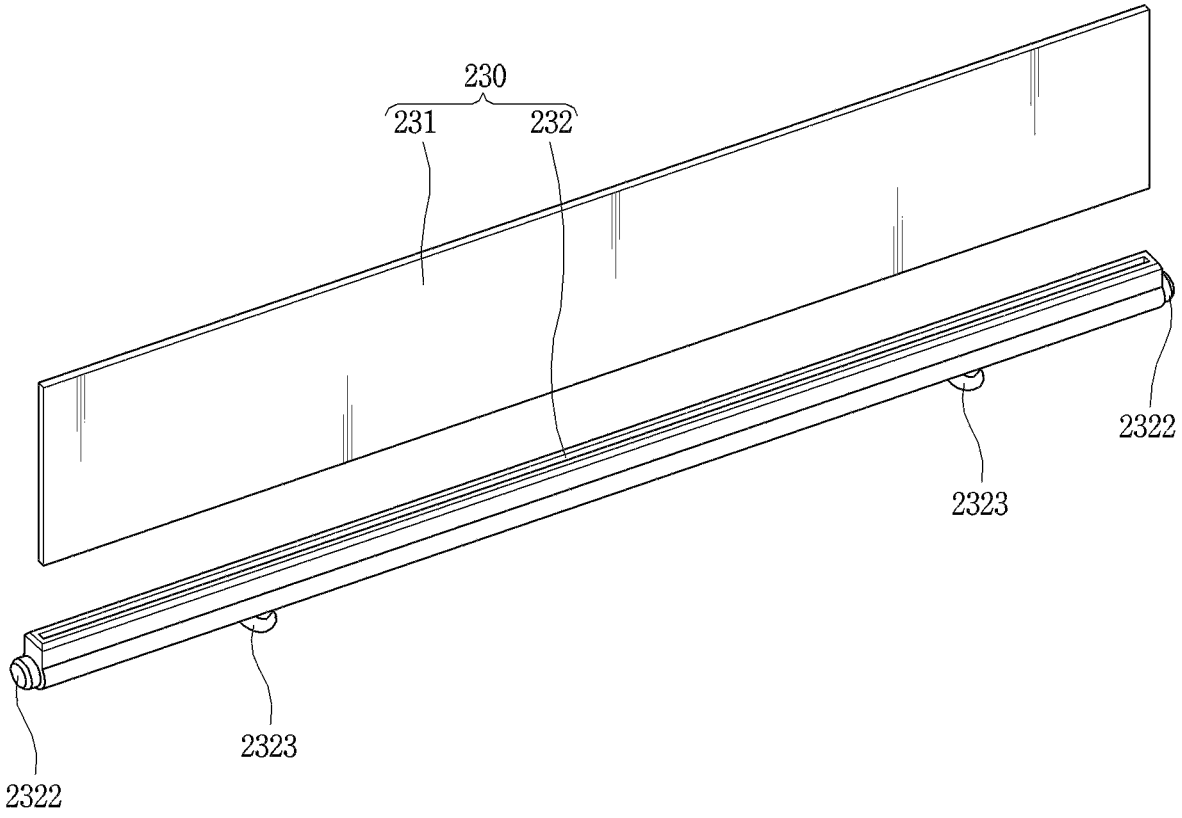
FIG. 8 is a perspective view illustrating a brush holder illustrated in FIG. 4.

FIG. 8 is a perspective view illustrating the brush portion illustrated in FIG. 4.

The brush portion 230 includes the brush 231 and the brush holder 232.

The brush 231 is formed of brushes or a rubber plate material. The brush 231 hits the surface to be cleaned to pick up or raise dust or foreign substances.

The brush holder 232 is provided in the recess groove 211 of the body member 210 in the length direction. The rotation protrusions 2322 protrude from both end portions thereof, respectively, in the length direction. Each of the rotation protrusions 2322 is rotatably coupled to the first rotation protrusion receiving hole 251*a* of the first end cap 250 and the second rotation protrusion receiving hole 261*a* of the second end cap 260.

That is, the brush holder 232 rotates with respect to an axis passing through the rotation protrusion 2322 in the recess groove 211.

A brush coupling portion 2321 into which the brush 231 is inserted is disposed at one side of the brush holder 232. Furthermore, the driven portion 2323 is disposed on the other side opposite to the one side.

The driven portion 2323 extends into the body member through the rotation guide hole 213 passing through the recess groove 211.

The brush portion 230 is rotated with respect to one side at which the rotation protrusion 2322 is disposed. That is, the brush 231 and the driven portion 2323 are rotated with respect to one side of the brush portion 230.

Figure 9:
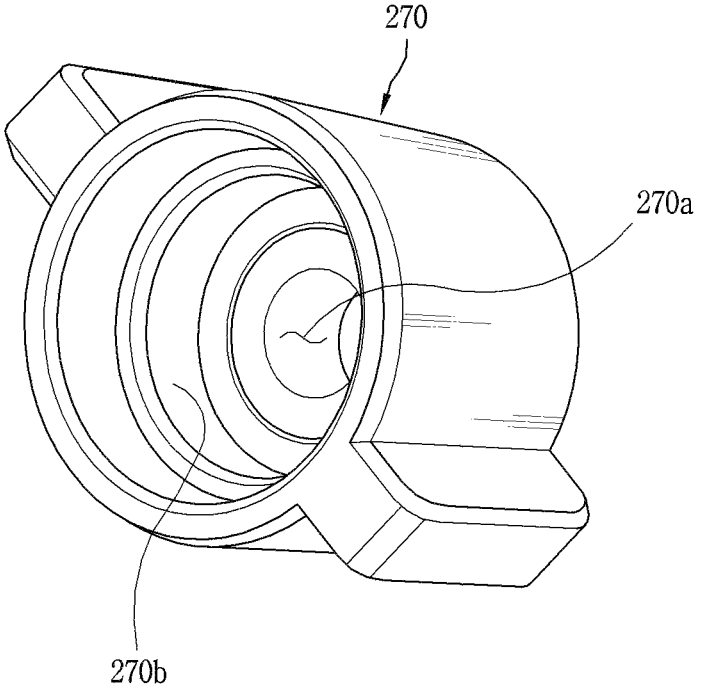
FIG. 9 is a perspective view illustrating a shaft receiving portion illustrated in FIG. 4.

FIG. 9 is a perspective view illustrating the shaft receiving portion illustrated in FIG. 4.

In the shaft receiving portion 270, the bearing receiving portion 270*b* and the shaft coupling hole 270*a* are sequentially disposed from a front side to a rear side. The shaft coupling hole 270*a* is a through hole into which the shaft 220 can be fitted. A rear end portion of the shaft 220 is rotatably fitted into the shaft coupling hole 270*a* by passing through the bearing receiving portion 270*b*. In a coupled state, a bearing is inserted between an outer peripheral surface of the shaft 220 and the bearing receiving portion 270*b*. Through this, the shaft 220 may be rotated separately from the shaft receiving portion 270.

Figure 10A:
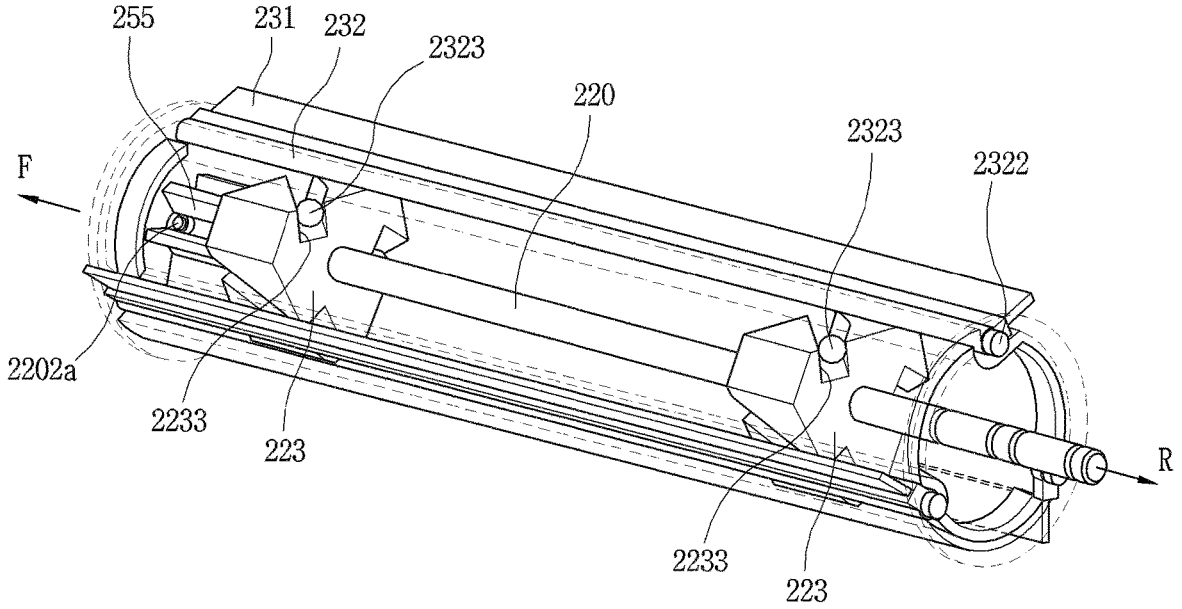
FIG. 10A is a perspective view illustrating a state before a brush portion of the agitator illustrated in FIG. 3 is extended.
Figure 10B:
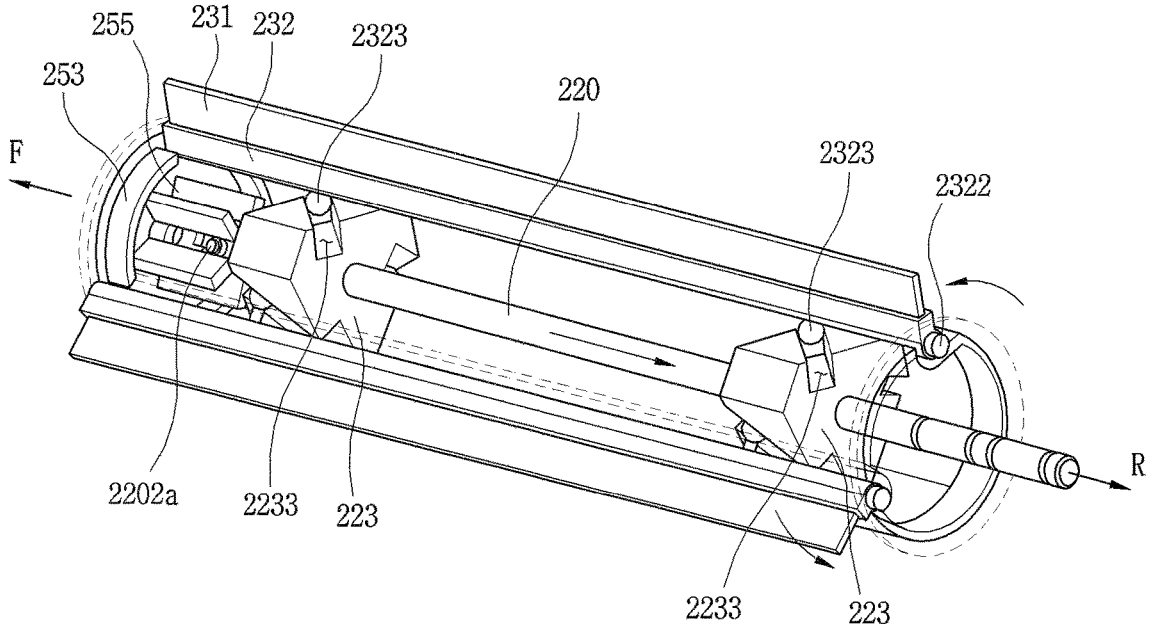
FIG. 10B is a perspective view illustrating a state in which the brush portion of the agitator illustrated in FIG. 3 is extended.

FIG. 10A is a perspective view illustrating a state before the brush portion of the agitator illustrated in FIG. 3 is extended, and FIG. 10B is a perspective view illustrating a state in which the brush portion of the agitator illustrated in FIG. 3 is extended.

For convenience of description, part of the body member 210, the first end cap 250, and the second end cap 260 are indicated by dotted lines. Furthermore, the E-ring 2205 is omitted.

During the cleaning process, the agitator 200 is rotated. As the agitator 200 is rotated, one end portion of the brush 231 of the agitator 200 is also rotated. When one end portion of the brush 231 hits a surface to be cleaned, dust or foreign substances placed on the surface to be cleaned is floated or picked up by the brush 231.

Here, a rotation radius of the brush 231 is a distance between the shaft 220 and the end portion of the brush 231 at the farthest position from the shaft 220.

Since a carpet is formed with fluff on the surface, the cleaner 100 is spaced apart from the surface of the carpet. Accordingly, in case where a surface to be cleaned is a carpet environment, when the rotation radius of the brush 231 is fixed, there may be a problem that the brush 231 does not reach the surface of the carpet.

An aspect of the present disclosure is to provide the agitator 200 having a structure capable of extending the rotation radius of the brush 231 when the surface to be cleaned is the carpet environment. As the rotation radius of the brush 231 is extended in the carpet environment, the brush 231 may reach the surface of the carpet.

The agitator 200 according to an embodiment of the present disclosure may extend the rotation radius of the brush 231 by rotating the brush portion 230 with respect to one side thereof.

Hereinafter, an operation process in which the rotation radius of the brush 231 is extended will be described.

The shaft 220 is positioned in the body member 210. The front side end portion of the shaft 220 is slidably coupled to the shaft guide portion 255 of the first end cap 250. Furthermore, the rear side end portion of the shaft 220 is slidably coupled to the shaft receiving hole 261*b* of the second end cap 250.

That is, the shaft 220 is supported by the shaft guide portion 255 and the shaft receiving hole 261*b*, and is moved in the length direction within the shaft guide portion 255 and the shaft receiving hole 261*b*.

The driving portion 223 protrudes from the outer peripheral surface of the shaft 220. As the shaft 220 reciprocates, the driving portion 223 is moved together.

The rotation guide groove 2233 extending at a predetermined angle with respect to the length direction of the shaft 220 is disposed at a radially outer side of the driving portion 223.

The brush portion 230 is rotated with respect to an axis passing through the rotation protrusion 2322. The axis passing through the rotation protrusion 2322 is referred to as a rotation axis. At this time, the brush 231 is extended to one side from the rotation axis, and the driven portion 2323 is extended to the other side therefrom. That is, the brush 231 and the driven portion 2323 are rotated with respect to the rotation axis.

The rotation guide groove 2233 guides the brush portion 230 to rotate. An end portion of the driven portion 2323 is inserted into the rotation guide groove 2233*b*. As the rotation guide groove 2233*b* moves in the length direction together with the shaft 220, the end portion of the driven portion 2323 is guided inside the rotation guide groove 2233*b*.

The movement of the driven portion 2323 in the rotation guide groove 2233*b* is as follows.

Since the driven portion 2323 is fixed to the body member 210, and the driven portion 2323 is fixed without moving in the length direction. However, the driven portion 2323 may be rotated by a predetermined angle with respect to the axis passing through the rotation protrusion 2322.

A rotation range of the rotation protrusion 2322 is determined by an inclination of the rotation guide groove 2233*b*.

Since the rotation guide groove 2233*b* extends at a predetermined angle with respect to the length direction, both end portions of the rotation guide groove 2233*b* are spaced apart from each other in a direction crossing the length direction. When it is referred to as a separation distance of the rotation guide groove 2233*b*, a movement distance of the end portion of the driven portion 2323 within the rotation range of the driven portion 2323 is determined by the separation distance.

When the driving portion 223 reciprocates along the length direction, the end portion of the driven portion 2323 in the rotation guide groove 2233*b* is reciprocated along the direction intersecting the length direction. Through this, the brush portion 230 is rotated. A distance between the shaft 220 and a radially outer side end portion of the brush 231 is varied by the rotation of the brush portion 230. That is, the rotation radius of the brush 231 is varied.

Referring again to FIG. 10A, a state in which the shaft 220 is maximally moved toward a front side is illustrated. A front side end portion of the shaft 220 is positioned adjacent to a rear surface of the first end cap 250. At this time, the end portion of the driven portion 2323 is accommodated at a rear side of the rotation guide groove 2233. This state is called a first state.

Referring again to FIG. 10B, a state in which the shaft 220 is maximally moved toward a rear side in the first state is illustrated. This state is called a second state. In the second state, the front side end portion of the shaft 220 moves away from the rear surface of the first end cap 250. At this time, the end portion of the driven portion 2323 is moved to the front side of the rotation guide groove 2233.

The front side and the rear side of the rotation guide groove 2233 are spaced apart from each other in a direction crossing the length direction. That is, the end portion of the driven portion 2323 is moved in the direction crossing the length direction. As the end portion of the driven portion 2323 is moved, the driven portion 2323 is rotated with respect to an axis passing through the rotation protrusion 2322. Through this, the brush 231 is also rotated with respect to the axis passing through the rotation protrusion 2322.

In other words, the brush 231 is rotated by a reciprocating movement of the driving portion 223.

Hereinafter, a process of varying the rotation radius of the brush 231 will be described with reference to FIG. 10C.

Figure 10C:
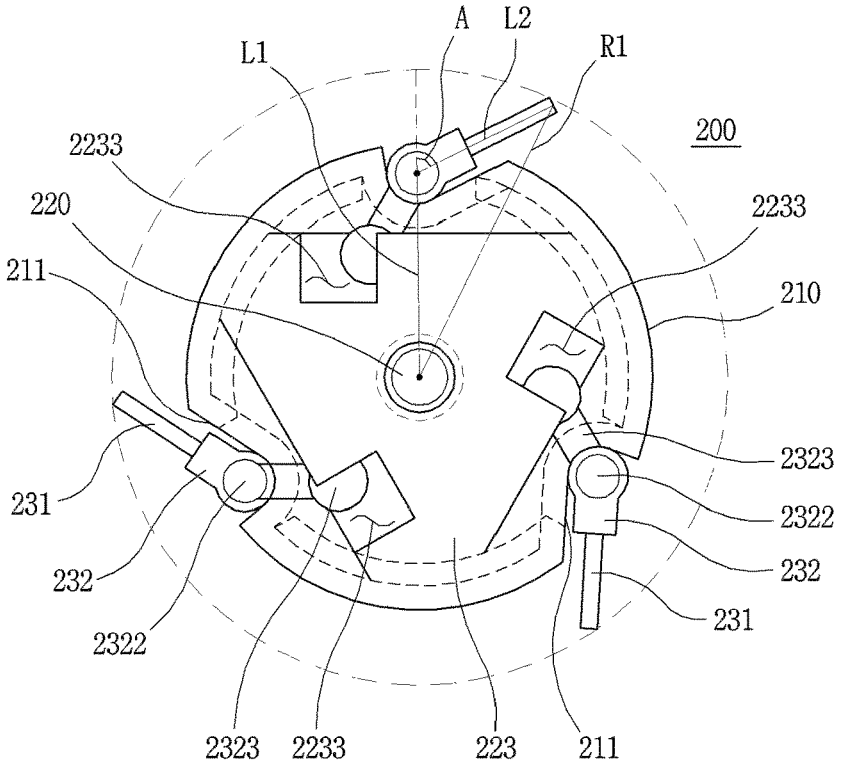
FIG. 10C is a side view illustrating an operation state of the brush portion of the agitator illustrated in FIG. 3.
Figure 10C:
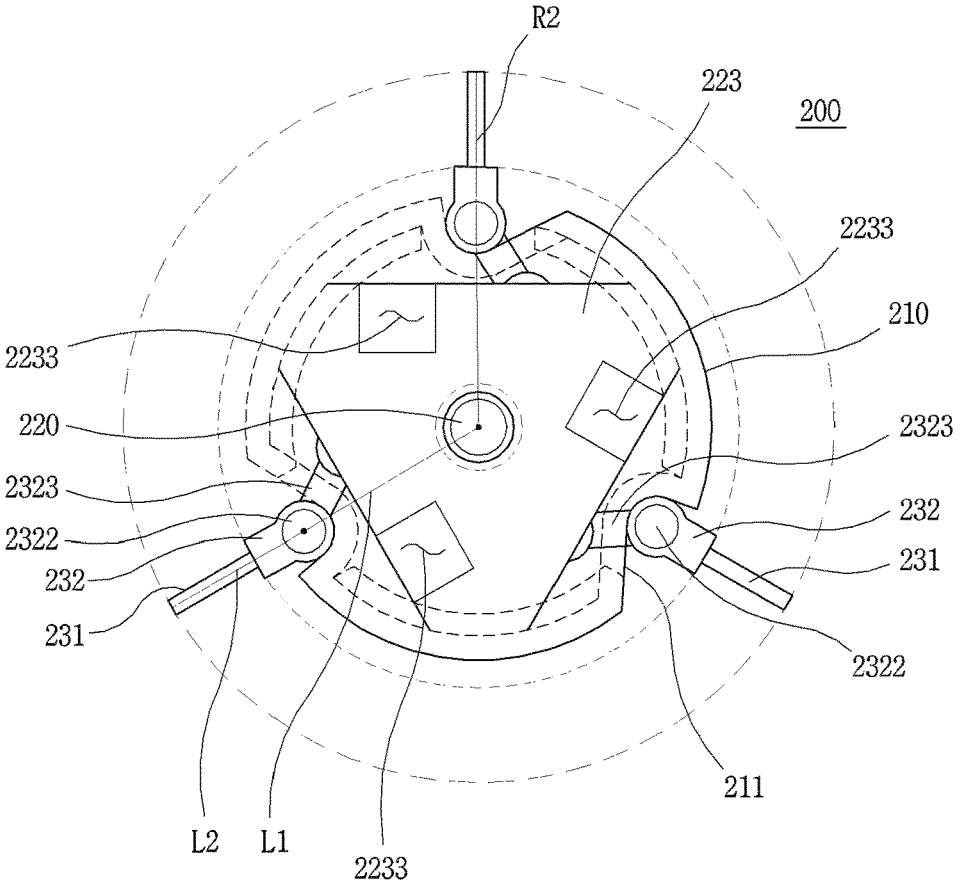

FIG. 10C is a side view illustrating an operation state of the brush portion of the agitator illustrated in FIG. 3.

For convenience of description, some of the components are indicated by dotted lines.

(a) of FIG. 10C illustrates a radius of rotation of the brush 231 in the first state, and (b) of FIG. 10C illustrates the rotation radius of the brush 231 in the second state.

In the first state, an end portion of the driven portion 2323 is accommodated at a rear side of the rotation guide groove 2233. At this time, the brush 231 forms an angle A with respect to an imaginary line passing a central axis of the shaft 220 and the rotation axis of the brush portion 230.

The central axis of the shaft 220 and a radially outer side end portion of the brush 231 are spaced apart by a first rotation radius R1. Furthermore, a distance between the central axis of the shaft 220 and the rotation axis of the brush portion 230 is spaced apart by L1, and a distance between the rotation axis of the brush portion 230 and the radially outer side end portion of the brush 231 is spaced apart by L2.

Here, the first rotation radius R1 can be obtained by the following equation.

$$R1=\sqrt{[L1^2+L2^2+2\times L1\times L2\times\cos(A)]}$$

Here, cos(A) has a value less than 1.

When the agitator 200 is changed from the first state to the second state, the end portion of the driven portion 2323 is moved toward the front side of the rotation guide groove 2233. By the movement of the end portion of the driven portion 2323, the brush portion 230 is rotated. At this time, the brush 231 is positioned in parallel to an imaginary line passing through the central axis of the shaft 220 and the rotation axis of the brush portion 230. That is, the brush 231 forms an angle of 0 with respect to an imaginary line passing the central axis of the shaft 220 and the rotation axis of the brush portion 230.

In the second state, the central axis of the shaft 220 and the radially outer side end portion of the brush 231 are spaced apart by a second rotation radius R2. Here, the second rotation radius R2 is L1+L2.

Here, values of the first rotation radius R1 and the second rotation radius R2 have the following relationship.

$$L1+L2>\sqrt{[L1^2+L2^2+2\times L1\times L2\times\cos(A)]}$$

That is, the second rotation radius R2 is formed to be larger than the first rotation radius R1.

In a carpet environment, the agitator 200 changes from the first state to the second state. Through this, the rotation radius of the brush 231 is extended from the first rotation radius R1 to the second rotation radius R2. As the rotation radius is extended, the brush 231 may reach even dust or foreign substances placed on the surface of the carpet. In other words, the rotation radius of the brush 231 may be extended even when the surface to be cleaned is changed, thereby preventing cleaning performance from being reduced.

Figure 11:
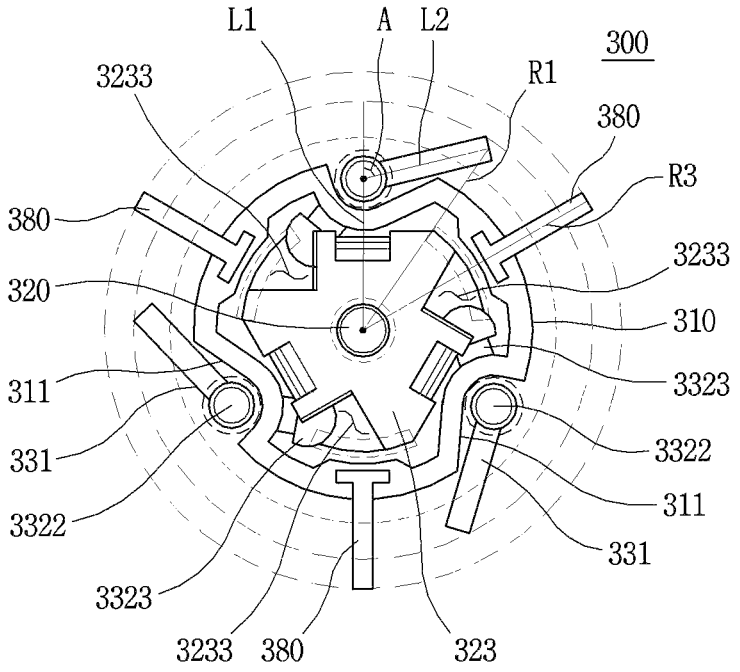
FIG. 11 is a side view illustrating a modified example of the agitator illustrated in FIG. 3.
Figure 11:
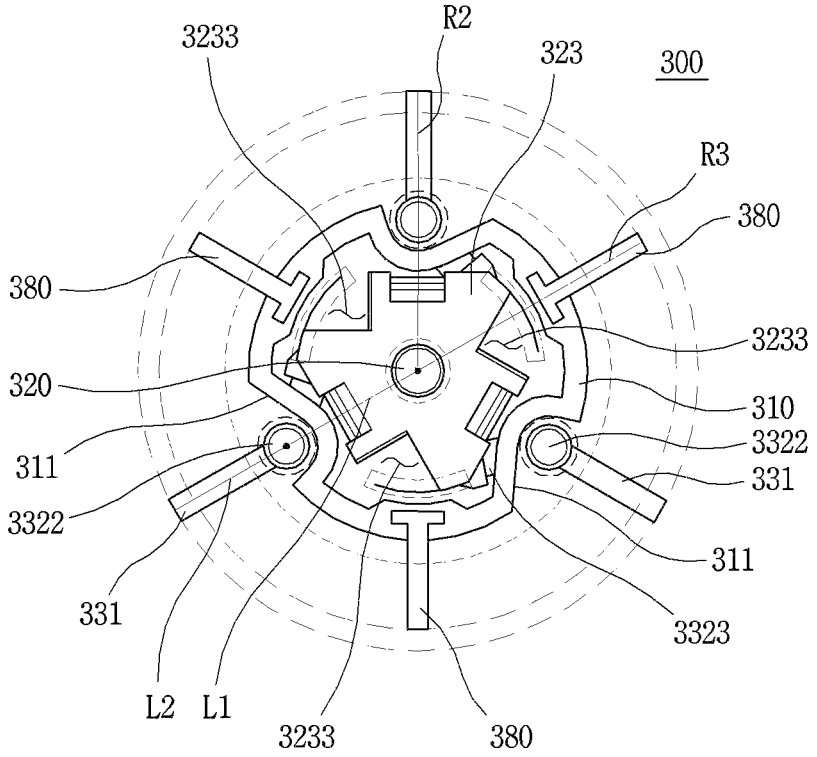

FIG. 11 is a side view illustrating a modified example of the agitator illustrated in FIG. 3.

(a) of FIG. 11 illustrates a first state before the brush 331 is extended. (b) of FIG. 11 illustrates a second state after the brush 331 is extended.

In FIG. 11, the fixed brush portion 380 protrudes from an outer peripheral surface of the body member 310. Another configuration that has not been described in FIG. 11 may be understood with reference to an embodiment of the present disclosure.

In the first state, an end portion of the driven portion 3323 is accommodated at a rear side of the rotation guide groove 3233. At this time, the brush 331 forms an angle A with respect to an imaginary line passing a central axis of the shaft 320 and the rotation axis of the brush portion 330.

The central axis of the shaft 320 and a radially outer side end portion of the brush 331 are spaced apart by a first rotation radius R1. Furthermore, a distance between the central axis of the shaft 320 and the rotation axis of the brush portion 330 is spaced apart by L1, and a distance between the rotation axis of the brush portion 330 and the radially outer side end portion of the brush 331 is spaced apart by L2.

Here, the first rotation radius R1 can be obtained by the following equation.

$$R1=\sqrt{[L1^2+L2^2+2\times L1\times L2\times\cos(A)]}$$

Here, cos(A) has a value less than 1.

When the agitator 300 is changed from the first state to the second state, the end portion of the driven portion 3323 is moved toward the front side of the rotation guide groove 3233. By the movement of the end portion of the driven portion 3323, the brush portion 330 is rotated. At this time, the brush 331 is positioned in parallel to an imaginary line passing through the central axis of the shaft 320 and the rotation axis of the brush portion 230. That is, the brush 331 forms an angle of 0 with respect to an imaginary line passing the central axis of the shaft 320 and the rotation axis of the brush portion 330.

In the second state, the central axis of the shaft 220 and the radially outer side end portion of the brush 331 are spaced apart by a second rotation radius R2. Here, the second rotation radius R2 may be expressed as L1+L2*cos (0). Here, the second rotation radius R2 is L1+L2.

Here, values of the first rotation radius R1 and the second rotation radius R2 have the following relationship.

$$L1+L2>\sqrt{[L1^2+L2^2+2\times L1\times L2\times\cos(A)]}$$

That is, the second rotation radius R2 is formed to be larger than the first rotation radius R1.

The fixed brush portion 380 protrudes from the outer peripheral surface of the body member 310 in the length direction. The fixed brush portion 380 may be integrated into or combined with the body member 310. A distance between the radially outer side end portion of the fixed brush portion 380 and the central axis of the shaft 320 is spaced apart by a third rotation radius R3.

At this time, the third rotation radius R3 is larger than the first rotation radius R1 and smaller than the second rotation radius R2. In addition, the fixed brush portion 380 may be disposed in parallel to a normal line of an outer peripheral surface of the body member 310 on which the fixed brush portion 380 is provided.

In the first state, the third rotation radius R3 is larger than the first rotation radius R1. Accordingly, the surface to be cleaned is cleaned by the fixed brush portion 380.

When the surface to be cleaned is changed from a hard floor to a carpet, the agitator 300 is changed from the first state to the second state. At this time, the rotation radius of the brush 331 is extended from the first rotation radius R1 to the second rotation radius R2. The second rotation radius R2 is larger than the third rotation radius R3 which is a rotation radius of the fixed brush portion 380. That is, the rotation radius is extended.

Through this, the brush 331 may reach even dust or foreign substances placed on the surface of the carpet. That is, the rotation radius of the brush 331 may be extended even when the surface to be cleaned is changed, thereby preventing cleaning performance from being reduced.

In other words, the surface to be cleaned is cleaned by the fixed brush portion 380 in the first state, and the surface to be cleaned is cleaned by the extended brush 331 in the second state.

When cleaning is performed only by the brush 331 without providing the fixed brush portion 380, the following problem may occur.

When the fixed brush portion 380 is not provided, the surface to be cleaned is cleaned by the brush 331 that is not extended in the first state. At this time, the brush 331 is inclined in a clockwise direction with respect to the rotation direction of the brush portion 330.

Here, when the agitator 300 rotates in the clockwise direction, a pressure at which the brush 331 strokes the surface to be cleaned may be excessively formed. This may adversely affect the durability of the brush 331.

On the contrary, when the agitator 300 rotates in a counterclockwise direction, a pressure at which the brush 331 strokes the surface to be cleaned may be insufficient. A difference in cleaning performance may be caused in the first state and the second state.

In the modified example illustrated in FIG. 11, in the first state, the fixed brush portion 380 is in parallel to a normal line of an outer peripheral surface on which the fixed brush portion 380 is provided. Furthermore, the brush 331 extended in the second state is in parallel to an imaginary line passing through an central axis of the shaft 320 and a rotation axis of the brush portion 330.

Through this, when the brush portion 380 or the brush 331 applies a stroke to a surface to be cleaned, the brush portion 380 or the brush 331 may be perpendicular to the surface to be cleaned.

That is, an appropriate stroke pressure can be applied to the surface to be cleaned in the first state and the second state without forming an excessive pressure to the brush 331.

Figure 12:
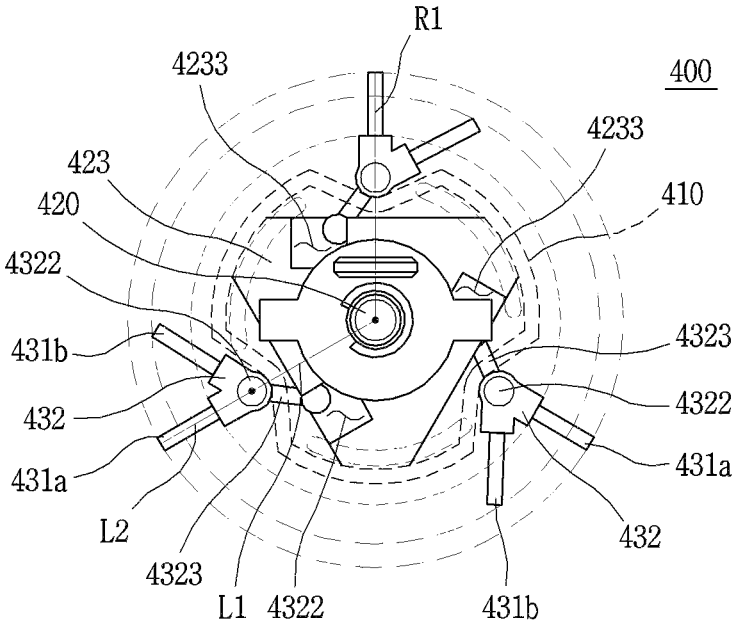
FIG. 12 is a side view illustrating another modified example of the agitator illustrated in FIG. 3.
Figure 12:
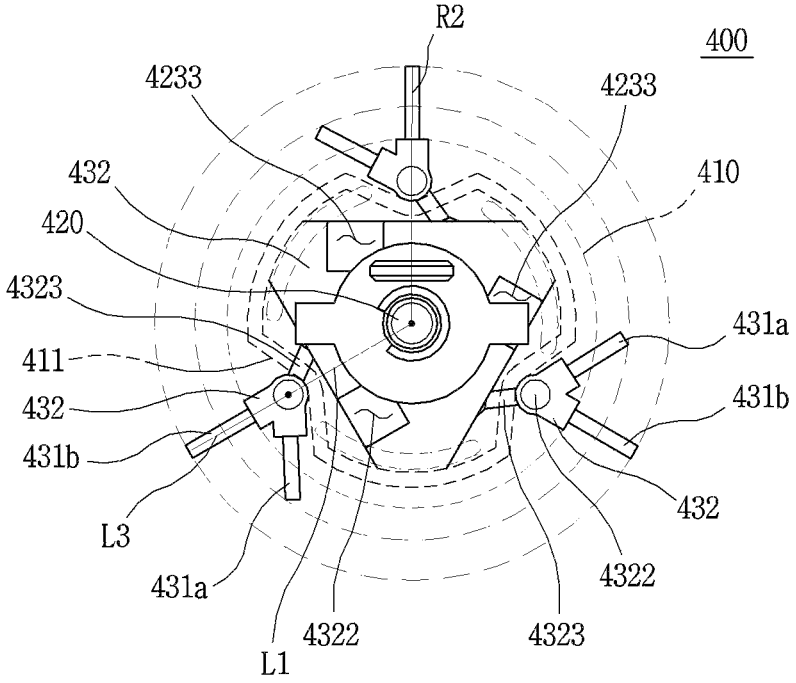

FIG. 12 is a side view illustrating another modified example of the agitator illustrated in FIG. 3.

(a) of FIG. 12 illustrates a first state before the brush 431 is extended. (b) of FIG. 12 illustrates a second state after the brush 431 is extended.

In FIG. 12, the brush portion 430 is illustrated in a modified form. A modified configuration that has not been described in FIG. 12 may be understood with reference to an embodiment of the present disclosure.

Referring to FIG. 12, a modified brush portion 430 is illustrated. The brush portion 430 may include a first brush 431*a* and a second brush 431*b* extending at a predetermined angle to each other.

A first brush coupling portion 2321*a* that accommodates the first brush 431*a* and a second brush coupling portion 2321*b* that accommodates the second brush 431*b* are disposed in the brush holder 432. A driven portion 4323 extends from a bottom surface of the brush holder 432.

The first brush 431*a* and the second brush 431*b* may be disposed to have different lengths. The first brush 431*a* is disposed to be shorter than the second brush 431*b*.

A distance between a rotation axis of the brush portion 430 and a radially outer side end portion of the first brush 431*a* is referred to as L2, and a distance between the rotation axis of the brush portion 430 and a radially outer side end portion of the second brush 431*b* is referred to as L3. In addition, a length between a central axis of the shaft 420 and the rotation axis of the brush portion 430 is referred to as L1.

In the first state, an end portion of the driven portion 4323 is accommodated at a rear side of the rotation guide groove 4233.

At this time, the first brush 431*a* is positioned in parallel to an imaginary line passing through the central axis of the shaft 420 and the rotation axis of the brush portion 430. That is, the first brush 431*a* forms an angle of 0 with respect to an imaginary line passing the central axis of the shaft 420 and the rotation axis of the brush portion 430.

The central axis of the shaft 420 and a radially outer side end portion of the first brush 431*a* are spaced apart by a first rotation radius R1. Here, the first rotation radius R1 is L1+L2.

That is, the first rotation radius R1 is a length of L1+L2, which is larger than a distance from the central axis of the shaft 420 to the radially outer side end portion of the second brush 431*b*.

That is, in the first state, a cleaning floor is cleaned by the first brush 431*a*.

When the agitator 400 is changed from the first state to the second state, the end portion of the driven portion 4323 is moved toward the front side of the rotation guide groove 4233. By the movement of the end portion of the driven portion 4323, the brush portion 430 is rotated.

At this time, the second brush 431*b* is positioned in parallel to an imaginary line passing through the central axis of the shaft 420 and the rotation axis of the brush portion 430. That is, the second brush 431*b* forms an angle of 0 with respect to an imaginary line passing the central axis of the shaft 420 and the rotation axis of the brush portion 430.

In the second state, the central axis of the shaft 420 and the radially outer side end portion of the second brush 431*b* are spaced apart by a second rotation radius R2. Here, the second rotation radius R2 is L1+L3.

That is, the first rotation radius R2 is a length of L1+L3, which is larger than a distance from the central axis of the shaft 420 to the radially outer side end portion of the second brush 431*a*.

That is, in the first state, a cleaning floor is cleaned by the second brush 431*b*.

In addition, since the length L3 of the second brush 431*b* is larger than the length L2 of the first brush 431*a*, the second rotation radius R2 is larger than the first rotation radius R1.

In other words, when the agitator 400 is changed from the first state to the second state, the rotation radius of the brush portion 430 for cleaning the surface to be cleaned is extended from the first rotation radius R1 to the second rotation radius R2.

When the surface to be cleaned is changed from a hard floor to a carpet, the agitator 400 is changed from the first state to the second state. At this time, the rotation radius of the brush portion 430 is extended from the first rotation radius R1 to the second rotation radius R2.

Through this, the second brush 431*b* may reach even dust or foreign substances placed on the surface of the carpet. That is, the rotation radius of the brush portion 430 may be extended even when the surface to be cleaned is changed, thereby preventing cleaning performance from being reduced.

In other words, the surface to be cleaned is cleaned by the first brush 431*a* in the first state, and the surface to be cleaned is cleaned by the second brush 431*b* in the second state.

In the modified example illustrated in FIG. 12, the first brush 431*a* in the first state and the second brush 431*b* in the second state is in parallel to an imaginary line passing through a central axis of the shaft 420 and a rotation axis of the brush portion 430.

Through this, when the first brush 431*a* or the second brush 431*b* applies a stroke to the surface to be cleaned, the first brush 431*a* or the second brush 431*b* may be perpendicular to the surface to be cleaned.

That is, an appropriate stroke pressure can be applied to the surface to be cleaned in the first state and the second state without forming an excessive pressure to the brush 331.

Figure 13A:
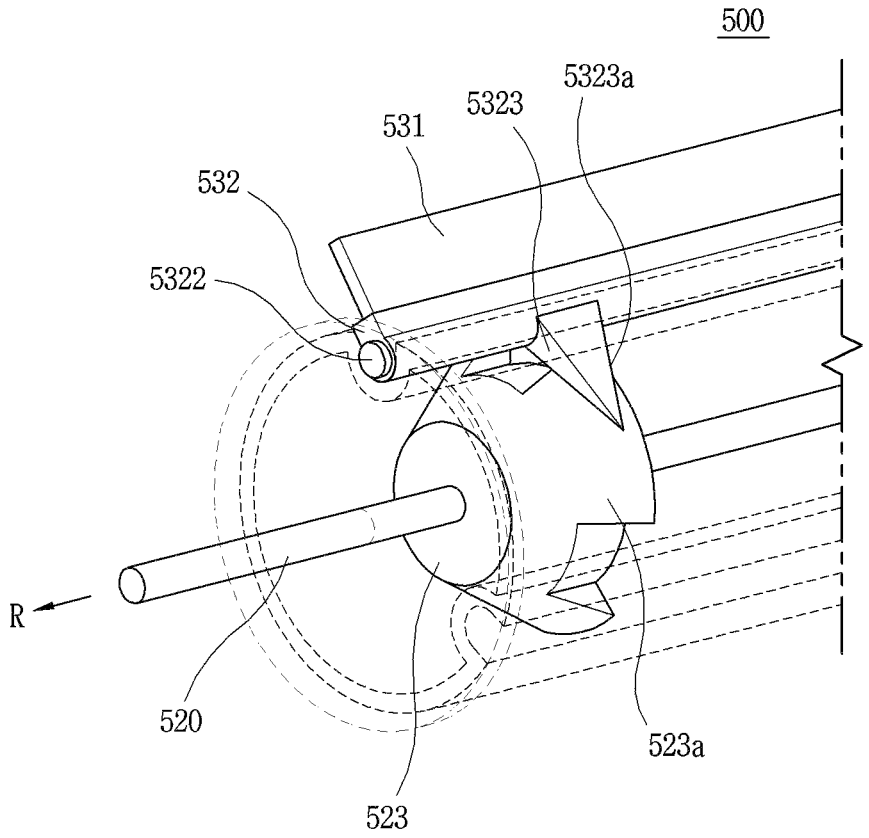
FIG. 13A is a partial perspective view illustrating still another modified example of the agitator illustrated in FIG. 3.
Figure 13B:
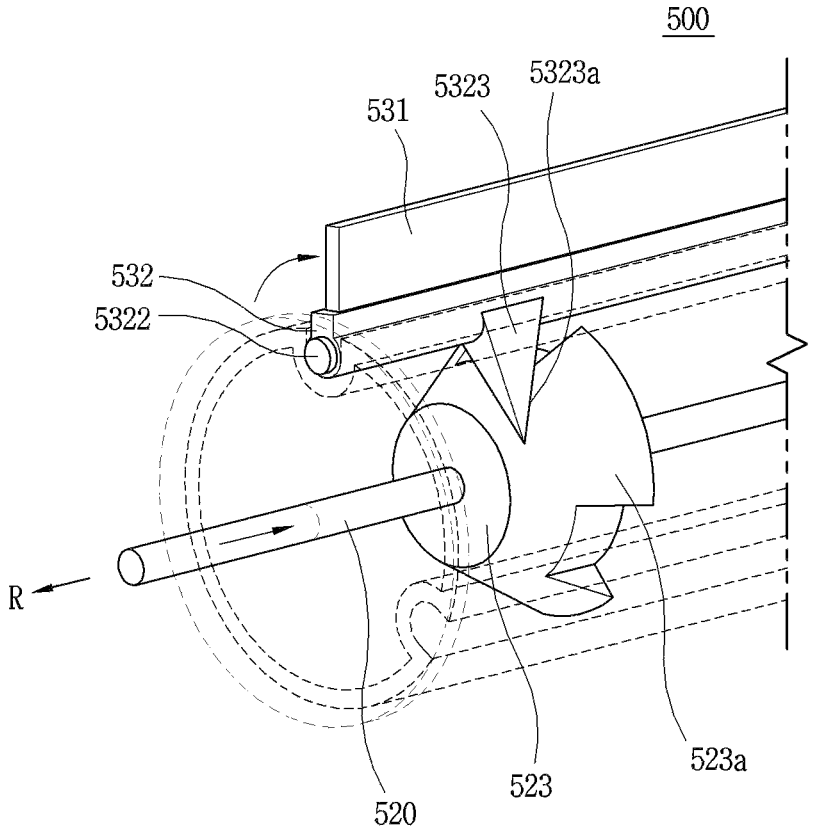
FIG. 13B is a partial perspective view illustrating a state in which a brush portion of the agitator illustrated in FIG. 13A is extended.

FIG. 13A is a partial perspective view illustrating another modified example of the agitator illustrated in FIG. 3, and FIG. 13B is a partial perspective view illustrating a state in which the brush of the agitator in FIG. 13A is extended.

That is, FIG. 13A illustrates the first state before the brush 531 is extended. FIG. 13B illustrates the second state after the brush 531 is extended.

In FIG. 13A, the driving portion 523 and the driven portion 5323 for rotating the brush portion 530 are illustrated in a modified form. FIG. 13 is a partial perspective view of a rear side of the agitator 500, and another non-modified configuration may be understood with reference to an embodiment of the present disclosure.

Referring to FIG. 13A, the driving portion 523 protrudes in a radial direction from the shaft 520. The driving portion 523 may be disposed in a truncated cone shape.

An inclined outer peripheral surface 523*a* of the driving portion 523 is inclined radially outward along the length direction.

The driven portion 5323 extending from the brush holder 532 into the body member 511 includes an inclined portion 5323*a*. The inclined portion 5323*a* is brought into contact with an outer peripheral surface 523*a* of the driving portion 523.

As the first state is moved to the second state, the shaft 520 is moved from a rear side to a front side. In this case, the driving portion 523 protruding from an outer peripheral surface of the shaft 520 is also moved from the front side to the rear side.

As the driving portion 523 is moved from the rear side to the front side, an inclined outer peripheral surface 523*a* of the driving portion 523 pushes the inclined portion 5323*a* of the driven portion 5323. The inclined portion 5323*a* is raised along the inclined outer peripheral surface 523*a*, and the driven portion 5323 is rotated with respect to an axis passing through the rotation protrusion 5322.

That is, the inclined outer peripheral surface 523*a* pushes the inclined portion 5323*a* to guide the driven portion 5323 to rotate.

As the driven portion 5323 is rotated, the brush 531 is also rotated with respect to an axis passing through the rotation protrusion 5322.

In other words, the brush 531 is rotated by a reciprocating movement of the driving portion 523.

Hereinafter, a process of varying the rotation radius of the brush 531 will be described with reference to FIG. 13C.

Figure 13C:
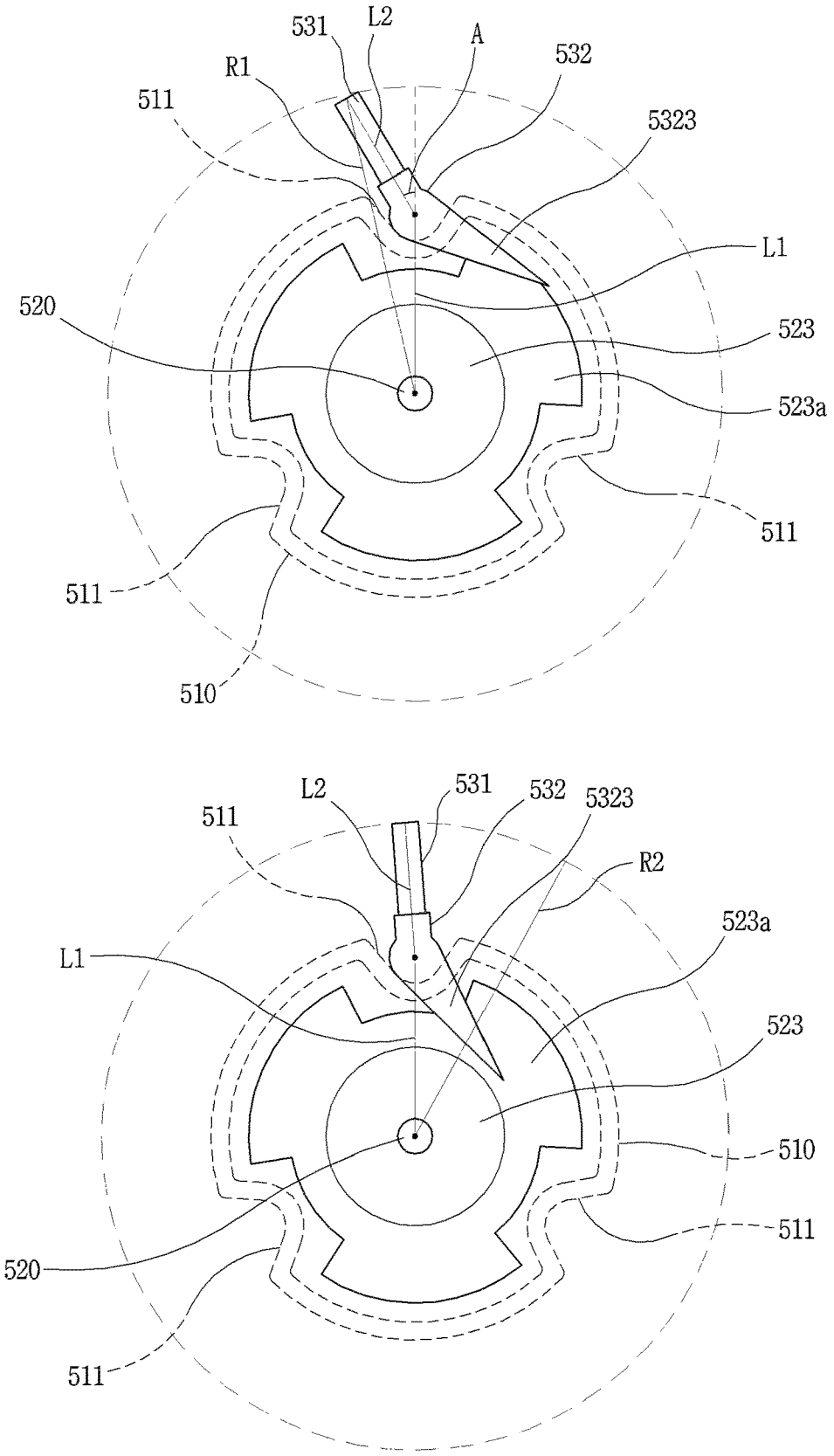
FIG. 13C is a side view illustrating an operation state of yet still another modified example of the agitator illustrated in FIG. 3.

FIG. 13C is a side view illustrating an operation state of the brush portion of the agitator illustrated in FIGS. 13A and 13B.

(a) of FIG. 13C illustrates a radius of rotation of the brush 531 in the first state, and (b) of FIG. 13C illustrates the rotation radius of the brush 531 in the second state.

In the first state, the inclined portion 5323*a* of the driven portion 5323 is brought into contact with the inclined outer peripheral surface 523*a* of the driving portion 523. At this time, the brush 531 forms an angle A with respect to an imaginary line passing a central axis of the shaft 520 and the rotation axis of the brush portion 530.

The central axis of the shaft 520 and a radially outer side end portion of the brush 531 are spaced apart by a first rotation radius R1. Furthermore, a distance between the central axis of the shaft 520 and the rotation axis of the brush portion 530 is spaced apart by L1, and a distance between the rotation axis of the brush portion 530 and the radially outer side end portion of the brush 531 is spaced apart by L2.

Here, the first rotation radius R1 can be obtained by the following equation.

$$R1=\sqrt{[L1^2+L2^2+2\times L1\times L2\times\cos(A)]}$$

Here, cos(A) has a value less than 1.

When the agitator 500 is changed from the first state to the second state, the inclined portion 5323*a* of the driven portion 5323 is raised along the inclined outer peripheral surface 523*a*. When the inclined portion 5322*a* is raised along the inclined outer peripheral surface 523*a*, the driven portion 5323 is rotated with respect to an axis passing through the rotation protrusion 5322. That is, the brush portion 530 is rotated.

At this time, the brush 531 is positioned in parallel to an imaginary line passing through the central axis of the shaft 520 and the rotation axis of the brush portion 530. That is, the brush 531 forms an angle of 0 with respect to an imaginary line passing the central axis of the shaft 520 and the rotation axis of the brush portion 530.

In the second state, the central axis of the shaft 520 and the radially outer side end portion of the brush 531 are spaced apart by a second rotation radius R2. Here, the second rotation radius R2 is L1+L2.

That is, values of the first rotation radius R1 and the second rotation radius R2 have the following relationship.

$$L1+L2>\sqrt{[L1^2+L2^2+2\times L1\times L2\times\cos(A)]}$$

That is, the second rotation radius R2 is formed to be larger than the first rotation radius R1.

In a carpet environment, the agitator 500 changes from the first state to the second state. Through this, the rotation radius of the brush 531 is extended from the first rotation radius R1 to the second rotation radius R2. As the rotation radius is extended, the brush 531 may reach even dust or foreign substances placed on the surface of the carpet. In other words, the rotation radius of the brush 531 may be extended even when the surface to be cleaned is changed, thereby preventing cleaning performance from being reduced.

Hereinafter, a cleaning unit including components for controlling the agitator of the present disclosure and a method of controlling the same will be described in detail with reference to FIGS. 14 to 16.

In the following description, the description of some components will be omitted to clarify the features of the present disclosure.

Figure 14:
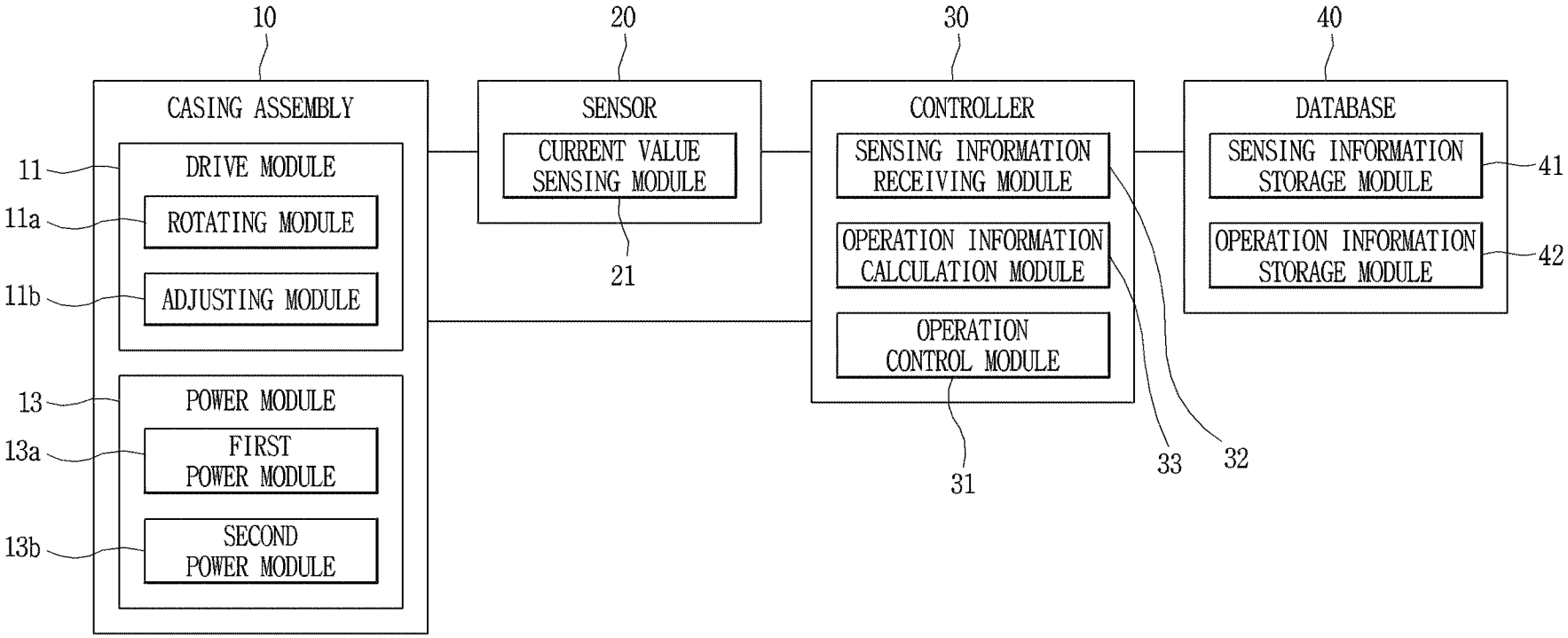
FIG. 14 is a block diagram illustrating a configuration for controlling a cleaning unit according to the present disclosure.

FIG. 14 is a block diagram illustrating a configuration for controlling a cleaning unit according to the present disclosure.

Referring to FIG. 14, the cleaning unit having components for controlling the agitator of the present disclosure includes a casing assembly 10, a sensor 20, a controller 30, and database 40.

First, the casing assembly 10 will be described.

The casing assembly 10 defines a casing of the cleaning unit of the present disclosure.

For example, the casing assembly 10 may be the cleaner body 110 in FIG. 1 illustrated to describe the related art robot cleaner.

A predetermined space is formed in the casing assembly 10. The sensor 20, the controller 30, and the database 40 may be provided in the space.

Also, the casing assembly 10 includes a drive (or driving) module 11 and a power module 13.

The drive module 11 may be driven by the power module 13. That is, a driving force generated by the power module 13 may be transmitted to the drive module 11.

In some implementations, the drive module 11 may include a rotating module 11*a* and an adjusting module 11*b*. The agitator 200, 300, 400, 500 according to the present disclosure may be used for the rotating module 11*a*, and the shaft receiving portion 270 according to the present disclosure may be used for the adjusting module 11*b*.

The power module 13 may include a first power module 13*a* and a second power module 13*b*. The first power module 13*a* as a module that produces a rotational force is connected to the rotating module 11*a* to rotate the rotating module 11*a*. The second power module 13*b* as a module that pushes and pulls the adjusting module 11*b* in a specific direction may be connected to the adjusting module 11*b* to drive the adjusting module 11*b*.

In some implementations, a servo motor that generates a rotational force may be used for the first power module 13*a*, and a linear servo motor that applies pressure in a specific direction may be used for the second power module 13*b*. However, other known power devices capable of generating a rotational force and applying pressure in a specific direction may be employed in addition to the servo motor and the linear servo motor.

The agitator 200, 300, 400, 500 connected thereto by the first power module 13*a* may be rotated. In addition, the shaft receiving portion 270, 370 may be pushed or pulled by the second power module 13*b* during rotation.

Through this, as the shaft 220, 320, 420, and 520 is moved in a front side direction, the rotation radius of the brush portion 230, 330, 430, 530 may be reduced.

In addition, as the shaft 220, 320, 420, 520 is moved in a rear side direction, the rotation radius of the brush portion 230, 330, 430, 530 may be extended.

In an embodiment of the present disclosure, the power module 13 may receive power from the outside. The power module 13 may be powered by a battery (not shown) provided at the cleaner body 110. The power module 13 may be electrically connected to the battery (not shown).

The first power module 13*a* and the second power module 13*b* may be driven independently. That is, rotation of the first power module 13*a* and the second power module 13*b*, the number of rotations, and the like may be controlled independently of each other. To this end, the first power module 13*a* and the second power module 13*b* may each be electrically connected to the controller 30.

Hereinafter, the sensor 20 will be described.

The sensor 20 may sense a value of current generated when the rotating module 11*a* is rotated by the first power module 13*a*. That is, the first power module 13*a* may sense the value of the current generated by rotating the agitator 200, 300, 400, 500.

Information sensed or detected by the sensor 20 is transmitted to the controller 30, allowing the controller 30 to generate control information appropriate for a given condition or situation.

The sensor 20 may be provided in a form capable of sensing a current value of the first power module 13*a*.

The sensor 20 may be electrically connected to a battery (not shown). Power required for the sensor 20 to be operated may be supplied from the battery (not shown).

The sensor 20 includes a current value sensor module 21 capable of detecting a value of current. In some implementations, the current value sensor module 21 may measure a current value by using an ammeter that is electrically connected to a circuit, or by measuring a magnetic field.

As the current value sensor module 21 senses the current value of the first power module 13*a*, condition of a floor on which the cleaner is currently operated may be sensed.

When the cleaner is located in a carpet environment rather than a hard floor environment, the wheels of the cleaner are buried for a predetermined length from the top of the carpet environment, and thereby the first power module 13*a* operates the agitator 200, 300, 400, 500. The current value used to rotate is increased.

The controller 30 may generate appropriate or proper operation information by comparing the current value detected by the current value sensor module 21 with a predetermined current value to determine that the cleaner is located on the carpet.

The current value sensor module 21 may be connected to the first power module 13*a* to measure the current value of the first power module 13*a*.

Hereinafter, the controller 30 will be described.

The controller 30 receives a current value from the sensor 20 and calculates operation information for operating the second power module 13*b*.

In addition, the controller 30 is electrically connected to the sensor 20 to receive the current value detected by the sensor 20.

The controller 30 may calculate operation information using the received sensing information. Further, the controller 30 may control the second power module 13*b* based on the calculated operation information. To this end, the controller 30 is electrically connected to the second power module 13*b*.

The controller 30 is electrically connected to the database 40. Information detected by the sensor 20 and information calculated by the controller 30 may be stored in the database 40.

Various modules of the controller 30 described hereafter are electrically connected to each other, such that information input to one module or information calculated by one module may be transmitted to another module.

The controller 30 may be provided in a form capable of inputting, outputting, and calculating information. In some implementations, the controller 30 may be provided in the form of a microprocessor, a central processing unit (CPU), a printed circuit board (PCB), or the like.

The controller 30 is located at a predetermined space formed in the cleaner body 110. The controller 30 may be accommodated in the space in a hermetically sealed manner so as not to be affected by external moisture, and the like.

The controller 30 includes a sensing information receiving module 32, an operation information calculation module 33, and an operation control module 31.

The operation information calculation module 33 calculates operation information for operating the second power module 13*b*.

The operation information calculation module 33 may calculate operation information using a current value of the first power module 13*a* transmitted to the sensing information receiving module 32. The operation control module 31 is electrically connected to the operation information calculation module 33.

The operation information may be achieved by the operation control module 31. The operation control module 31 is configured to control the second power module 13*b* corresponding to the calculated operation information.

Specifically, the operation information denotes information in which the second power module 13*b* pushes or pulls the shaft receiving portion 270. As the shaft receiving portion 270 is pushed or pulled by the second power module 13*b*, the agitator 200, 300, 400, 500 may reduce or extend the rotation radius of the brush portion 230, 330, 430, 530 during rotation.

Hereinafter, the database 40 will be described.

The database 40 stores information regarding operation of the cleaner.

The database 40 may be provided in a form capable of inputting, outputting, and storing information. In some implementations, the database 40 may be provided in the form of an SD card, a micro SD card, USB memory, an SSD, or the like.

The database 40 is electrically connected to the operation information calculation module 33. Operation information calculated by the operation information calculation module 33 may be transmitted to the database 40 to be stored.

The database 40 is electrically connected to the sensor 20 through the sensing information receiving module 32. A current value detected by the sensor 20 may be transmitted to the database 40 to be stored.

The database 40 includes a sensing information storage module 41 and an operation information storage module 42. The modules 41 and 42 may be electrically connected to each other.

The operation information storage module 42 stores operation information calculated by the operation information calculation module 33. The operation information storage module 42 is electrically connected to the operation information calculation module 33.

The sensing information storage module 41 may store sensing information according to specific operation information. The sensing information storage module 41 is electrically connected to the operation information storage module 42.

A process of sensing by the sensor 20, information processing and a process of calculation by the controller 30, and a process of storing information in the database 40 may be performed in real time.

Hereinafter, a method of controlling length extension of the brush assembly of the cleaning unit according to the present disclosure will be described in detail with reference to FIGS. 15 to 16.

Figure 15:
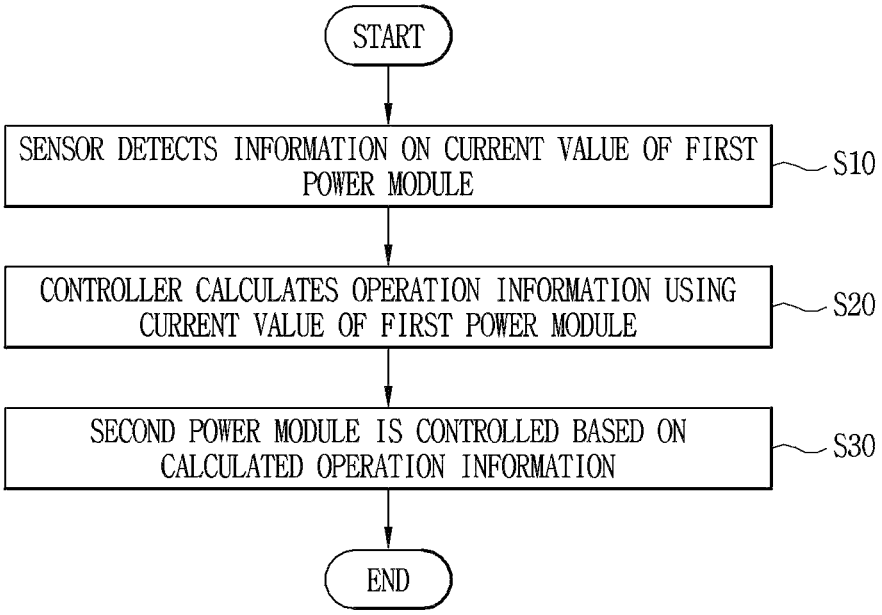
FIG. 15 is a flowchart illustrating a flow of a method of controlling the cleaning unit according to the present disclosure.

FIG. 15 is a flowchart illustrating a flow of a method of controlling the cleaning unit according to the present disclosure.

When the cleaner is operated on the floor, the sensor 20 detects a current value of the first power module 13*a* (S10).

The first power module 13*a* is connected to the agitator 200, 300, 400, 500 of the cleaner to rotate the agitator 200, 300, 400, 500. The agitator 200, 300, 400, 500 is connected to the suction nozzle module 120, and is exposed to the floor environment to rotate when the suction nozzle module 120 slidably moves in the floor environment.

When the suction nozzle module 120 is moved by the wheel module 160 off from the floor with a predetermined distance. When the cleaner travels on a hard floor surface, the agitator 200, 300, 400, 500 provided at the suction nozzle module 120 is rotated at a specific distance away from the floor.

When the cleaner is moved from the hard floor surface to a carpet, the wheel module 160 is buried under a predetermined depth of the carpet, which allows the agitator 200, 300, 400, 500 to be located closer to the carpet than the hard floor surface.

Accordingly, the brush portion 230, 330, 430, 530 of the agitator 200, 300, 400, 500 receives more resistance compared to the hard floor surface, causing more amount of current to flow in the first power module 13*a* that rotates the agitator 200, 300, 400, 500.

A current value flowing through the first power module 13*a* may be detected by the current value sensing module 21 included in the sensor 20.

When the current value sensing module 21 detects the current value flowing through the first power module 13*a*, the controller 30 calculates operation information using the current value of the first power module 13*a* (S20).

The current value of the first power module 13*a* measured by the current value sensing module 21 is received by the sensing information receiving module 32 of the controller 30, and the operation information calculation module 33 calculates operation information using the current value received by the sensing information receiving module 32.

When the operation information calculation module 33 calculates the operation information, the second power module 13*b* is controlled based on the calculated operation information (S30).

The operation information calculated by the operation information calculation module 33 is transmitted to the operation control module 31, and the second power module 13*b* is operated by the operation control module 31 according to the operation information.

The operation information includes allowing the second power module 13*b* to push the shaft receiving portion 270 toward a front side at a predetermined pressure, or allowing the second power module 13*b* to pull the shaft receiving portion 270 toward a rear side at a predetermined pressure.

The process of calculating operation information by the operation information calculation module 33 will be described in detail with reference to FIG. 16.

Figure 16:
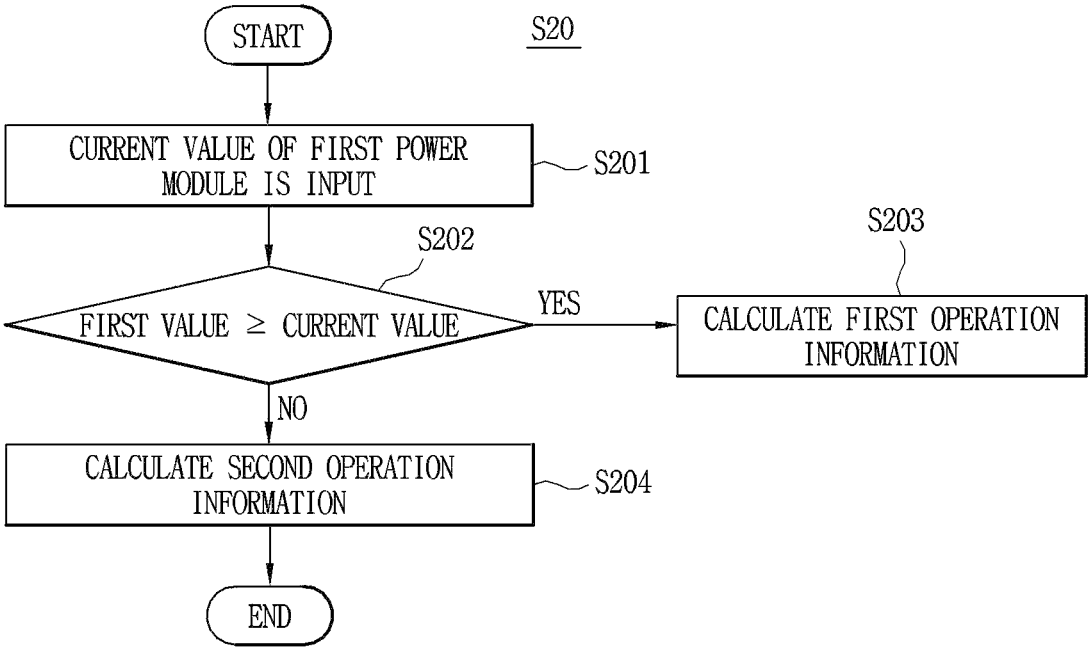
FIG. 16 is a flowchart illustrating an embodiment of step S20 in FIG. 15.

FIG. 16 is a flowchart illustrating an embodiment of step S20 in FIG. 15.

A current value of the first power module 13*a* is input to allow the controller 30 to calculate operation information using the current value (S201).

The current value of the first power module 13*a* is transmitted to the sensing information receiving module 32 of the controller 30, and the operation information calculation module 33 compares it with a predetermined first value (S202).

When the transmitted current value is less than the predetermined first value, the operation information calculation module 33 calculates first operation information (S203).

The first value is a set value of current flowing in the first power module 13*a* when the first power module 13*a* is driven on a carpet. When the transmitted current value is less than the first value, the operation information calculation module 33 determines that the cleaner is used or operated on a hard floor surface, not the carpet.

That is, the first operation information includes information that pushes the shaft receiving portion 270 toward the front side at a predetermined pressure.

The first operation information is transmitted to the operation control module 31, and the operation control module 31 controls the second power module 13*b* to push the shaft receiving portion 270 toward the front side at a predetermined pressure.

When the transmitted current value is greater than the predetermined first value, the operation information calculation module 33 calculates second operation information (S204).

The first value is a set value of current flowing in the first power module 13*a* when the first power module 13*a* is driven on the carpet. When the transmitted current value is greater than the first value, the operation information calculation module 33 determines that the cleaner is operated on the carpet.

That is, the second operation information includes information allowing the second power module 13*b* to pull the shaft receiving portion 270, 370 toward the rear side at a predetermined pressure so as to extend the rotation radius of the brush portion 230, 330, 430, 530 of the agitator 200, 300, 400, 500 during rotation.

That is, the second operation information is transmitted to the operation control module 31, and the operation control module 31 controls the second power module 13*b* to pull the adjusting module 11*b* toward a rear side at a predetermined pressure.

As described above, the cleaning unit according to the present disclosure may be used in a device that is automatically operated, such as a robot cleaner, so as to be automatically controlled such that the length of the brush assembly can be extended according to floor conditions.

The extension of the brush portion of the cleaner unit including the agitator 200, 300, 400, 500 according to the present disclosure is not limited to being performed by automatic control.

The shaft 220, 320, 420, 520 may be performed by a mechanical configuration connected to the shaft receiving portion 270 so as to push or pull. For example, the brush portion 230, 330, 430, 530 may be mechanically extended by a user's button manipulation.

Though the present disclosure is described with reference to preferred embodiments, various modifications and improvements will become apparent to those skilled in the art without departing from the concept and scope of the present disclosure as defined in the following claims.

The invention claimed is:

1. A cleaning unit, comprising:

a columnar body portion in which a rotation guide hole is disposed on an outer peripheral surface thereof;

a shaft provided to reciprocate a predetermined distance in a length direction in a hollow disposed in the body portion;

a driving portion protruding from the shaft in a radial direction;

a brush portion having one side provided on an outer peripheral surface of the body portion along the length direction to rotate with the one side as a rotation axis thereof; and a driven portion extending from the brush portion toward the driving portion to be inserted into a rotation guide groove disposed in the driving portion through the rotation guide hole, wherein the rotation guide groove extends at a predetermined angle with respect to the length direction of the shaft, and wherein as the shaft reciprocates, the driven portion is guided to rotate by the rotation guide groove, and the brush portion is rotated by the rotation of the driven portion.

2. The cleaning unit of claim 1, wherein a distance between the shaft and the other end of the brush portion becomes the minimum when the shaft is maximally moved toward one side of the body portion, and becomes the maximum when the shaft is maximally moved toward the other side opposite to the one side.

3. The cleaning unit of claim 1, wherein the cleaning unit further comprises a fixed brush portion extending radially outward from the outer peripheral surface of the body portion, wherein a distance between the shaft and the other end of the brush portion is spaced apart by a first rotation radius, which is a minimum value, when the shaft is maximally moved toward one side of the body portion, and is spaced apart by a second rotation radius, which is a maximum value, when the shaft is maximally moved toward the other side opposite to the one side, and wherein a distance between the shaft and a radially outer side end portion of the fixed brush portion is larger than the first rotation radius, and is smaller than the second rotation radius.

4. The cleaning unit of claim 1, wherein the brush portion comprises a first brush and a second brush respectively extending from one side of the brush portion to a radially outer side of the body portion, and wherein the first brush and the second brush form a predetermined angle to each other, and extension direction lengths of the first brush and the second brush are different from each other.

5. The cleaning unit of claim 1, wherein the brush portion and the driven portion extending from the brush portion are disposed in plurality in the body portion along a circumferential direction, and wherein the rotation guide groove is disposed in plurality on the driving portion along the circumferential direction.

6. The cleaning unit of claim 5, wherein the driving portion is disposed in plurality along the length direction on the shaft, and wherein the driven portion is disposed in plurality along the length direction of the brush portion.

7. The cleaning unit of claim 1, wherein the body portion comprises:

a hollow body member disposed with a recess groove on which the brush portion is provided on an outer peripheral surface thereof, both ends of which are open; and a first end cap and a second end cap respectively fitted to both ends of the body member to cover the both ends, respectively.

8. The cleaning unit of claim 7, wherein one side of the brush portion is accommodated in the recess groove, wherein rotation protrusions are disposed at both ends of one side of the brush portion in a length direction, and wherein the first end cap and the second end cap are provided with receiving holes rotatably coupled to the rotation protrusions.

9. The cleaning unit of claim 7, wherein the shaft comprises a power transmission pin passing through one side of the shaft, and wherein the first end cap comprises a shaft guide portion slidably coupled to one side of the shaft.

10. The cleaning unit of claim 9, wherein a shaft guide hole slidably coupled to the shaft is disposed in the second end cap, and wherein the shaft comprises an E-ring protruding in a radial direction, and the E-ring is disposed in plurality with the second end cap interposed therebetween to limit a reciprocating movement distance of the shaft.

11. The cleaning unit of claim 10, wherein the cleaning unit further comprises a shaft receiving portion mounted on the other side of the shaft, wherein a bearing is inserted between the shaft receiving portion and the shaft, and wherein the E-ring is disposed in plurality with the shaft receiving portion therebetween to fix the shaft receiving portion in a length direction.

12. The cleaning unit of claim 11, wherein the cleaning unit further comprises:

a first power module coupled to the first end cap to rotate the shaft;

a second power module connected to the shaft receiving portion to push and pull the shaft receiving portion according to operation information;

a sensor connected to the first power module and configured to detect a current value of the first power module; and a controller that calculates the operation information, which is electrically connected to the second power module to transmit the calculated operation information to the second power module, and electrically connected to the sensor to receive a current value of the first power module that is detected from the sensor, and wherein the controller calculates the operation information using the detected current value of the first power module.

13. The cleaning unit of claim 12, wherein the operation information comprises first operation information and second operation information, wherein the second power module receives the first operation information to push the shaft receiving portion at a predetermined pressure, and receives the second operation information to pull the shaft receiving portion at a predetermined pressure, and wherein the controller calculates the first operation information when the detected current value of the first power module is greater than or equal to a first value, and calculates the second operation information when the detected current value of the first power module is less than the first value.

14. A cleaning unit, comprising:

a columnar body portion in which a rotation guide hole is disposed on an outer peripheral surface thereof;

a shaft provided to reciprocate a predetermined distance in a length direction in a hollow disposed in the body portion;

a driving portion protruding from the shaft in a radial direction, and having an outer peripheral surface inclined radially outward along the length direction;

a brush portion having one side provided on an outer peripheral surface of the body portion along the length direction to rotate with the one side as a rotation axis thereof; and a driven portion extending from the brush portion into the body portion through the rotation guide hole, wherein the driven portion has an inclined portion in contact with the outer peripheral surface, and wherein as the shaft reciprocates, the driven portion is rotated by the outer peripheral surface, and the brush portion is rotated by the rotation of the driven portion.

15. The cleaning unit of claim 14, wherein a distance between the shaft and the other end of the brush portion becomes the minimum when the shaft is maximally moved toward one side of the body portion, and becomes the maximum when the shaft is maximally moved toward the other side opposite to the one side.

16. The cleaning unit of claim 14, wherein the brush portion and the driven portion extending from the brush portion are disposed in plurality along a circumferential direction of the body portion.

17. The cleaning unit of claim 16, wherein the driving portion is disposed in plurality along the length direction on the shaft, and wherein the driven portion is disposed in plurality along the length direction of the brush portion.

* * * * *